US011649727B2

(12) United States Patent
Caldwell et al.

(10) Patent No.: US 11,649,727 B2
(45) Date of Patent: May 16, 2023

(54) VALVE TIMING IN ELECTRONICALLY COMMUTATED HYDRAULIC MACHINE

(71) Applicant: ARTEMIS INTELLIGENT POWER LIMITED, Loanhead (GB)

(72) Inventors: Niall Caldwell, Loanhead (GB); Daniel Abrahams, Loanhead (GB); Andrew Latham, Loanhead (GB)

(73) Assignee: ARTEMIS INTELLIGENT POWER LIMITED, Loanhead (GB)

( * ) Notice: Subject to any disclaimer, the term of this patent is extended or adjusted under 35 U.S.C. 154(b) by 32 days.

(21) Appl. No.: 16/729,196

(22) Filed: Dec. 27, 2019

(65) Prior Publication Data

US 2020/0208521 A1 Jul. 2, 2020

(30) Foreign Application Priority Data

Dec. 28, 2018 (EP) ..... 18275269

(51) Int. Cl.

| | |
|---|---|
| ***F01B 1/06*** | (2006.01) |
| ***F04B 1/06*** | (2020.01) |
| *F04B 17/02* | (2006.01) |

(52) U.S. Cl.

CPC ..... *F01B 1/0675* (2013.01); *F04B 1/06* (2013.01); *F04B 17/02* (2013.01)

(58) Field of Classification Search

None

See application file for complete search history.

(56) References Cited

U.S. PATENT DOCUMENTS

| | | | | |
|---|---|---|---|---|
| 4,052,971 | A | 10/1977 | Salzgeber et al. | |
| 4,453,522 | A | 6/1984 | Salzgeber | |
| 6,470,853 | B1 | 10/2002 | Leone et al. | |
| 2012/0023918 | A1* | 2/2012 | Laird | F04B 7/0042 60/459 |
| 2012/0059523 | A1* | 3/2012 | Salter | F03D 9/25 700/281 |
| 2012/0060684 | A1* | 3/2012 | Lavender | F04B 9/04 92/12.1 |
| 2012/0260765 | A1* | 10/2012 | Fox | C11B 1/12 74/567 |
| 2012/0260795 | A1* | 10/2012 | Rampen | F01B 1/062 91/218 |
| 2012/0312158 | A1* | 12/2012 | Rampen | F04B 17/02 74/567 |

(Continued)

FOREIGN PATENT DOCUMENTS

| | | | |
|---|---|---|---|
| EP | 2055950 A1 | 5/2009 | |
| EP | 2775144 A2 * | 9/2014 | F04B 49/22 |

(Continued)

*Primary Examiner* — Bryan M Lettman
*Assistant Examiner* — Geoffrey S Lee
(74) *Attorney, Agent, or Firm* — Hauptman Ham, LLP

(57) ABSTRACT

An electronically commutated hydraulic machine is coupled to a drivetrain. Working chambers of the hydraulic machine are connected to low and high pressure manifold through electronically controlled valves. The phase of opening and closing of the valves has a default. In order to avoid cycle failure due to acceleration events, for example due to backlash in the drivetrain, the phase of opening or closing of the electronically controlled valves is temporarily advanced or retarded from the default timing.

26 Claims, 13 Drawing Sheets

(56) References Cited

U.S. PATENT DOCUMENTS

| | | | | |
|---|---|---|---|---|
| 2013/0067900 | A1* | 3/2013 | Tsutsumi | F04B 23/00 60/446 |
| 2013/0149171 | A1* | 6/2013 | Caldwell | F03D 80/88 417/218 |
| 2013/0205763 | A1* | 8/2013 | Caldwell | F04B 49/246 60/459 |
| 2013/0214537 | A1* | 8/2013 | Hashimoto | F03D 9/255 290/55 |
| 2013/0221676 | A1* | 8/2013 | Caldwell | F03D 15/00 290/55 |
| 2016/0208898 | A1* | 7/2016 | Caldwell | F16H 61/4183 |
| 2019/0154030 | A1* | 5/2019 | Brett | F04B 49/065 |
| 2019/0249651 | A1* | 8/2019 | Melinosky | F04B 23/06 |
| 2020/0080541 | A1* | 3/2020 | Bourgault | F03D 15/10 |
| 2020/0109706 | A1* | 4/2020 | Kozaki | F04B 37/14 |
| 2020/0208521 | A1* | 7/2020 | Caldwell | F04B 1/06 |
| 2020/0386101 | A1* | 12/2020 | Marshall | F04B 1/047 |
| 2021/0017988 | A1* | 1/2021 | Hase | F04D 27/0261 |

FOREIGN PATENT DOCUMENTS

| | | | |
|---|---|---|---|
| EP | 2775144 | A2 | 9/2014 |
| EP | 2851562 | A1 | 3/2015 |
| GB | 2477999 | A | 8/2011 |
| WO | 2008012587 | A2 | 1/2008 |
| WO | 2014118906 | A1 | 8/2014 |

* cited by examiner

VALVE TIMING IN ELECTRONICALLY COMMUTATED HYDRAULIC MACHINE

FIELD OF THE INVENTION

The invention relates to machines, including but not limited to vehicles, with drive trains which include electronically commutated hydraulic machines.

BACKGROUND TO THE INVENTION

Electronically commutated hydraulic machines (ECMs) comprise one or more working chambers of cyclically varying volume, in which the displacement of fluid through the working chambers is regulated by electronically controllable valves, on a cycle by cycle basis and in phased relationship to cycles of working chamber volume, to determine the net throughput of fluid through the machine.

It is known for such machines to intersperse active cycles of working chamber volume (in which there is a net displacement of working fluid) and inactive cycles of working chamber volume (with no significant net displacement of working fluid) to meet a demand signal. Active cycles may be pumping cycles with a net displacement of working fluid from a low pressure manifold to a high pressure manifold or motoring cycles in which case the net flow of fluid is in the other direction.

Such machines may occasionally be subject to cycle failure, when a working chamber does not properly execute the cycle which it is commanded to carry out. A first mode of cycle failure known as a 'valve holding fail' occurs for example if, during a motoring cycle, a low pressure valve, such as a poppet valve, closes too late in the exhaust stroke to compress the trapped working fluid to at least the pressure of the high pressure manifold, then the high pressure valve of the respective working chamber will not open in preparation for drawing fluid from the high pressure manifold in a subsequent expansion stroke then the motoring cycle is not possible and will not happen on that cycle.

Similarly, another form of cycle failure may be referred to as reverberation phenomenon, whereby if the high pressure valve closes too late in the expansion stroke of a motoring cycle, this prevents the working chamber from sufficiently decompressing, thus preventing the respective low pressure valve from reopening to exhaust fluid from the working chamber and therefore causing fluid to be returned to the high pressure manifold on the compression stroke, again leading to a failure to carry out an effective motoring cycle. This form of cycle failure creates a full sinusoidal torque profile, around zero torque, leading to substantially no net displacement, and torque reversal within one shaft revolution.

A further form of cycle failure is that of failure to pump, whereby if the LPV is actuated too early in the stroke, the compression stroke may simply displace working fluid out through the LPV to the LP manifold. If the LPV is actuated too late, this can result in reduced pumped flow, below the commanded displacement for the respective cylinder.

A primary motivation for wanting to avoid cycle failure, or breakdown, is to avoid or reduce system instability, for example in the form of high shaft speed oscillation or sudden high shaft accelerations possibly during resonance or other events. Cycle failure may lead to and promote more cycle failure, thus further highlighting the motivation to avoid this state. Of course a certain low level of shaft acceleration is acceptable. System instability arising from such instability can lead to component damage (due to high or cyclic forces), reduced system efficiency (due to sub-optimal operation of the ECM), and reduced operator or driver experience (since they may feel vibration or sudden jerking forces).

An important parameter of an ECM is actual displacement fraction (ADF), by which we refer to the fraction of the maximum stroke volume of a working chamber of an ECM which is displaced during a cycle (output in a pumping cycle or input in a motoring cycle). During full mode cycles (those active cycles which are not limited to part volume, called part mode cycles, for some reason), the ADF would ideally be as high as is practical. In an efficiently operating ECM, carrying out full mode cycles, during a motoring cycle, the ADF might be about 85-90%, although a higher ADF, for example around 95% can typically be achieved during a pumping cycle. When operating with full mode (as distinct from part mode) cycles, it is desirable to operate at the highest possible ADF, in order to most efficiently utilise the working chambers. However, attempts to maximise ADF may lead to cycle failure.

It is known from EP2386026 (Rampen et al.) to vary the timing of actuation of a valve in an ECM taking into account measurements of properties of the performance of the ECM during earlier cycles, in order to more efficiently operate the machine, by enabling valve times to be delayed within a cycle as long as it is safe to do so, thereby increasing the ADF while avoiding failure of that cycle.

We have also found that cycle failure can be associated with transient pressure changes in the high pressure manifold.

It is an object of the invention to avoid or reduce cycle failure within an electronically commutated hydraulic machine while still enabling the machine to operate efficiently, with a good ADF.

The invention is especially applicable where the ECM is coupled to a drivetrain, for example an industrial drivetrain, a vehicle drivetrain, or other drivetrain. We have found that cycle failure may be associated with events such as backlash.

SUMMARY OF THE INVENTION

According to a first aspect of the invention there is provided a method of controlling a fluid working machine, the fluid working machine comprising a rotatable shaft, at least one working chamber having a volume which varies cyclically with rotation of the rotatable shaft, a low pressure manifold and a high pressure manifold, a low pressure valve for regulating communication between the low pressure manifold and the working chamber, a high pressure valve for regulating communication between the high pressure manifold and the working chamber, the method comprising actively controlling one or more said valves in phased relationships with cycles of working chamber volume, to determine the net displacement of fluid by the working chamber on a cycle by cycle basis, wherein for a given cycle type, a control signal to cause the opening or closing of the low or high pressure valve is transmitted to the valve at a default phase of a cycle of working chamber volume and, responsive to a measurement or prediction of an event associated with a temporary acceleration of the rotatable shaft or an event associated with a temporary change in the pressure in the high pressure manifold, the corresponding control signal to cause the opening or closing of the low or high pressure valve is transmitted at an alternative phase of a cycle of working chamber volume, which alternative phase is advanced or retarded relative to the default phase.

Thus, when events occur which cause sudden accelerations of the rotatable shaft, the timing of the transmission of a valve control signal is automatically brought forwards, or retarded, as appropriate, to avoid, or reduce the risk of cycle failure. Nevertheless, this is temporary and in normal operation the control signals are transmitted at the default phase. The accelerations may be in either direction and by acceleration we include negative acceleration (deceleration). The event associated with a temporary acceleration of the rotatable shaft may therefore be an event associated with a temporary increase or decrease in the speed of rotation of the rotatable shaft. The temporary acceleration may be a transient acceleration.

We have found that these temporary accelerations can be a particular cause of cycle failure. They typically arise due to a temporary change in torque, for example a transient decrease in torque due to backlash between gears in a drivetrain driven by the fluid working machine. The rotatable shaft is typically coupled to a drive train. Automatically bringing forwards, or retarding, as appropriate, the timing of the valve control signal, reduces the risk of or prevents cycle failures due to these temporary accelerations and thereby improves the reliability and smoothness of operation of the fluid working machine and apparatus including the fluid working machine.

We have also found that temporary changes in the pressure in the high pressure manifold can cause cycle failure, by changing the precise phase at which valves open or close, particularly the phase of opening or closing the high pressure valve. The temporary changes in pressure are typically transient changes. The temporary changes in the pressure are typically changes due to movements in components (e.g. actuators) coupled to the high pressure manifold (and driven by or driving the fluid working machine).

Typically, in the case of a motoring cycle, the transmission of said control signal is caused to temporarily be advanced relative to the default phase. There may be a plurality of control signals with different default phases which cause the opening or closing of either or both of the low or high pressure valve and the plurality of control signals may each be advanced (by the same or different amounts) relative to their respective default phase.

Typically, in the case of a pumping cycle, the transmission of said control signal is caused to temporarily be retarded relative to the default phase. There may be a plurality of control signals with different default phases which cause the opening or closing of either or both of the low or high pressure valve and the plurality of control signals may each be retarded (by the same or different amounts) relative to their respective default phase.

There can be delays between the transmission of the control signal to cause the opening or closing of the low or high pressure valve and the actual opening or closing. This can be due for example to the response time of a valve actuator (e.g. a solenoid actuator of the low or high pressure valve, as appropriate), the time required for components within a valve to move, the time required for the force exerted on a valve member to exceed the forces arising from a pressure differential or stiction, etc. The important delays include that from the decision to send the control signal, i.e. at a decision point, to the actual signal being sent. The transmission of the control signals determines target phases of valve opening or closing. Unexpected accelerations or pressure changes may cause the actual phase of valve opening or closing to differ significantly from the target phase.

It may be that there is a default phase of opening or closing of the low or high pressure valve which would be the target phase if the control signal was transmitted at the default phase and there was no temporary acceleration or pressure change. It may be that the transmission of the control signal at the alternative phase causes the target phase of the opening or closing of the low or high pressure valve to be corresponding advanced or retarded relative to the default phase. Thus, the opening or closing of the low or high pressure valve may be advanced or retarded as a result of a control signal which is advanced or retarded. However, it may be that the transmission of the control signal at the alternative phase causes the target phase of the opening or closing of the low or high pressure valve to remain the default phase. Thus, the opening or closing of the low or high pressure valve may be maintained, despite the temporary acceleration or pressure change, as a result of the use of the alternative phase.

The given cycle type may for example be a pumping cycle or a motoring cycle.

It may be that in the case that the cycle type is a motoring cycle in which there is a net displacement of working fluid from the high pressure manifold to the low pressure manifold, the method comprises either or both of (i) advancing the phase of the transmission of a control signal which causes the closing of the low pressure valve during the contraction stroke of a cycle of working chamber volume and (ii) advancing the phase of the transmission of a control signal which causes the opening of the high pressure valve during the expansion stroke of a cycle of working chamber volume.

Active control of the opening or closing of a valve may comprise actively opening, actively closing, actively holding open, actively holding closed, or stopping actively holding open or actively holding closed. This will depend on whether the valve is biased or not, and, if so, whether it is biased open or closed. The required action also depends on the pressure in the working chamber at the required time and so the direction in which forces act across the respective valve member.

The control signal to cause the valve opening or closing may for example comprise the rising or falling edge of a digital signal, the starting, stopping, or varying the magnitude or mark to space ratio of a current. In some embodiments, the control signal comprises the stopping or reduction of a current which has been holding a valve open or closed against a pressure differential.

The control signal is typically transmitted by a controller, for example a hardware processor.

Typically, during a motoring cycle, the control signal may cause the opening of a high pressure valve (for example transmitting the control signal may comprise applying or increasing a current to a solenoid actuator) or the control signal may cause the high pressure valve to stop being held closed (for example transmitting the control signal may comprise stopping or reducing a current previously applied to a solenoid actuator).

It may be that, in the case that the cycle type is a pumping cycle in which there is a net displacement of working fluid from the low pressure manifold to the high pressure manifold, the method comprises retarding the phase of the transmission of a control signal which causes the closing of the low pressure valve during the contraction phase of a cycle of working chamber volume.

It may be that the rotatable shaft is coupled to a drive train, wherein the event which is measured or predicted is a discontinuity in the torque exerted on the rotatable shaft by the drive train, for example due to backlash.

A discontinuity in the torque exerted on the rotatable shaft by the drive train may cause transient rapid acceleration of the rotatable shaft. This may in turn lead to cycle failure. This may arise from transient decreases in the torque exerted on the rotatable shaft, or from changes in the direction of the torque exerted on the rotatable shaft and/or changes in the direction of rotation of the fluid working machine. Transient increases in torque may also cause cycle failure.

The discontinuity in the torque may be caused by a gear box or clutch, for example. The discontinuity in the torque may be caused by backlash. The discontinuity may occur when there is a change in the sense of torque exerted on the rotatable shaft by the drive train.

It may be that the discontinuity in the torque exerted on the rotatable shaft is predicted from the pattern of decisions as to the cycle type of successive cycles of working chamber volume.

The cycle type may for example be pumping or motoring. Backlash is likely when switching from pumping to motoring or vice versa.

It may be that the event which is measured or predicted is an oscillation in the speed of rotation of the rotatable shaft.

The oscillation which is measured or predicted may be an oscillation in the speed of rotation of the rotatable shaft as a whole or a torsional vibration mode of the rotatable shaft.

It may be that the event which is measured or predicted is a vibration arising from a pattern of a selection of working chambers to carry out active cycles in which a working chamber makes a net displacement of working fluid, and inactive cycles, in which a working chamber makes substantially no net displacement of working fluid.

This prediction may be carried out with reference to the value of a demand signal, indicative of a demand for displacement of working fluid by the fluid working machine (optionally expressed as a fraction of maximum possible displacement per revolution of the rotatable shaft, $F_d$) and/or with reference to the speed of rotation of the rotatable shaft.

Thus, where it is predicted that there may be vibrations (e.g. in the fluid working machine or components connected thereto) which may otherwise cause cycle failure, the valve opening or closing time may be advanced or retarded (revised, as appropriate) to avoid or reduce the risk of this.

It may be that events leading to an acceleration of the rotatable shaft are monitored and used to predict future events leading to an acceleration of the rotatable shaft Acceleration of the rotatable shaft can be detected, for example, using a shaft rotational speed sensor. Future events can be predicted, for example using machine learning methods.

It may be that the event which is predicted or measured is predicted responsive to a received actuation signal.

For example, an actuation signal may be received which causes a machine to change gear and an event associated with an acceleration of the rotatable shaft may be predicted as a result.

The actuation signal may be an actuation signal for an event which causes an acceleration of the rotatable shaft or temporary change in the pressure in the high pressure manifold.

It may be that the fluid working machine is operated in a first (default) mode, with the control signals transmitted at the default phase, by default and is operated in a second (conservative) mode, with the control signals transmitted at the alternative phase, responsive to the measurement or prediction of an event.

Thus the fluid working machine may be operated in the first (default) mode (with the control signals transmitted at the default phase) continuously, and then temporarily operated in the second (conservative) mode (with the control signals transmitted at the alternative phase) continuously, responsive to the measurement or prediction of an event, and then operated in the first (default) mode continuously, again.

It may be that the revised phase (e.g. in the second mode) is distinct from the default phase (e.g. in the first mode). However, it may be that the revised phase is variable or continuous within a range extending to the default phase (i.e. advanced from a phase which is distinctly before the default phase, up to the default phase, or retarded from the default phase to a phase which his distinctly after the default phase).

The transmission of the control signal is typically controlled to temporarily occur at the alternative phase (i.e. advanced or retarded relative to the default phase), for example operated in said second mode, for less than 20%, or less than 10%, or less than 2% of the time.

Typically, at least some of the time, the alternative phase of the control signal differs from the default phase by at least 1° or at least 3°.

It may be that the phase of transmission of the control signal changes from the default phase to the alternative phase (for example when the mode of operation switches from the first mode to the second mode), or vice versa, the phase of transmission of the control signal changes progressively over a plurality of cycles of working chamber volume.

The phase of the transmission of the control signal may be varied from one cycle to a subsequent cycle within a predetermined maximum slew rate.

Alternatively, it may be that when the phase of transmission of the control signal changes from the default phase to the alternative phase, or vice versa, there is a step change in the phase of transmission of the control signal.

It may be that the difference between the default phase and the alternative phase is variable.

The angle by which the phase of transmission of the control signal is altered (advanced or retarded) relative to the default phase may be a function of a property (e.g. magnitude) of the measured or predicted event.

The angle by which the phase of the transmission of the control signal is altered (advanced or retarded) relative to the default phase may be selected to obtain a specific effect, for example a specific decrease in the net displacement of a working chamber during a cycle or working chamber volume.

It may be that the difference between the default phase and the alternative phase depends on the type of event which was detected or predicted.

It may be that the default phase of transmission of the control signal varies with the measured speed of rotation of the rotatable shaft.

Where there is a significant delay between transmission of the control signal to cause the low or high pressure valve to open or close and the actual opening or closing, there is vulnerability to cycle failure due to sudden acceleration of the rotatable shaft, between the time when the control signal is transmitted and when the corresponding control signal is transmitted and the actual resulting opening or closing of the low or high pressure valve. The time between the control signal being transmitted and the completion of opening or closing of the low or high pressure valve varies as a fraction of the period of a cycle of working chamber volume. The fraction will be higher for a higher shaft speed, and become a more important consideration.

It may be that the difference between the alternative phase and the default phase is variable, for example in dependence on the expected magnitude of a temporary acceleration or in response to a measured variable, or in response to an AC component of speed of rotation of the rotatable shaft or high pressure manifold pressure.

The measured variable may, for example, be the magnitude of a measured oscillation in rotatable shaft speed. The amount by which the phase differs between the alternative phase and the default phase may depend on the predicted or detected event. The difference between the alternative phase and the default phase may be a function of the speed of rotation of the rotatable shaft.

It could be that the magnitude of the phase difference between the alternative phase and the default phase is varied in response or proportion to the AC component of the shaft speed or in response or proportional to the AC component of the HP manifold pressure, in such a way that oscillations of the drivetrain or oscillations in the HP manifold pressure, are actively damped. This could be done so as to reduce the risk of cycle failure due to the accelerations associated with oscillations of the drivetrain.

It may be that the phase difference between the alternative phase and the default phase is varied such as to damp oscillations of the rotatable shaft or of the pressure in the high pressure manifold.

For example, the alternative phase may be selected so that the phase of resulting valve opening or closing is advanced so as to reduce torque during shaft acceleration, and retarded to increase torque during shaft deceleration. The phase difference between the alternative phase and the default phase may therefore be varied in phase or antiphase with oscillations in the rotatable shaft or pressure in the high pressure manifold (determined from a shaft speed sensor or pressure sensor as appropriate).

It may be that the default phase is variable over time.

Although the alternative phase is always advanced or retarded (as appropriate) with reference to a default phase, the default phase may change over time, for example, responsive to measurement of the timing of valve opening or closing during earlier cycle of working chamber volume. The default phase may be a function of measured pressure in the high pressure manifold. This is because fluid compression and/or decompression time varies with hydraulic fluid pressure.

The drive train may be driven by or may drive the fluid working machine. In some embodiments, the drive train at some times is driven by and at some times drives the fluid working machine, for example in a vehicle with regenerative braking.

While the said opening or closing of the low or high pressure valve is actively controlled to temporarily occur at a revised phase of a cycle of working chamber volume, relative to the default phase, the method may comprise interleaving active cycles of working chamber volume in which there is a net displacement of working fluid with inactive cycles in which there is no net displacement of working fluid.

The invention extends in a second aspect to apparatus comprising a fluid working machine, the fluid working machine comprising a rotatable shaft, at least one working chamber having a volume which varies cyclically with rotation of the rotatable shaft, a low pressure manifold and a high pressure manifold, a low pressure valve for regulating communication between the low pressure manifold and the working chamber, a high pressure valve for regulating communication between the high pressure manifold and the working chamber, a controller configured to actively control one or more said valves in phased relationships with cycles of working chamber volume, to determine the net displacement of fluid by the working chamber on a cycle by cycle basis, wherein for a given cycle type, the controller is configured to by default transmit control signals to the low or high pressure valves at a default phase of a cycle of working chamber volume, the control signals causing the opening or closing of the low or high pressure valves and, responsive to a measurement or prediction of an event associated with a temporary acceleration of the rotatable shaft or an event associated with a temporary change in the pressure in the high pressure manifold, to transmit the controls signals at an alternative phase of cycles of working chamber volume, which alternative phase is advanced or retarded relative to the default phase.

It may be that the rotatable shaft is coupled to a drive train and wherein the measurement or prediction of an event associated with a temporary acceleration of the rotatable shaft or an event associated with a temporary change in the pressure in the high pressure manifold is a measurement or prediction of an event associated with a discontinuity in the torque exerted on the rotatable shaft by the drive train, for example due to backlash.

Said apparatus may be operated by monitoring the speed of rotation of the rotatable shaft, detecting instances of temporary accelerations of the rotatable shaft, analysing operating parameters when the detected instances occur, determining parameters of a prediction algorithm responsive thereto and subsequently predicting events associated with a temporary acceleration of the rotatable shaft or an event associated with a temporary change in the pressure in the high pressure manifold using the prediction algorithm and the determined parameters, and responsive thereto actively controlling the said opening or closing of the low or high pressure valve to temporarily occur at the alternative phase.

It may be that as a result of transmitting the control signals at the alternative phase, there is a reduction in the net displacement of working fluid by each working chamber and the proportion of working chambers caused to carry out active cycles, instead of inactive cycles, is increased automatically as part of an algorithm, according to which the ECM operates. It may be that as a result of operating in the second (conservative) mode instead of the first (default mode), the proportion of working chambers caused to carry out active cycles, instead of inactive cycles, is increased automatically as part of an algorithm, according to which the ECM operates.

Optional features mentioned in respect of the first or second aspect of the invention are optional features of either aspect of the invention. The apparatus of the second aspect may be operated by the method of the first aspect. The method of the first aspect may be a method of operating apparatus according to the second aspect.

DESCRIPTION OF THE DRAWINGS

An example embodiment of the present invention will now be illustrated with reference to the following Figures in which.

DETAILED DESCRIPTION OF AN EXAMPLE EMBODIMENT

Figure 1:
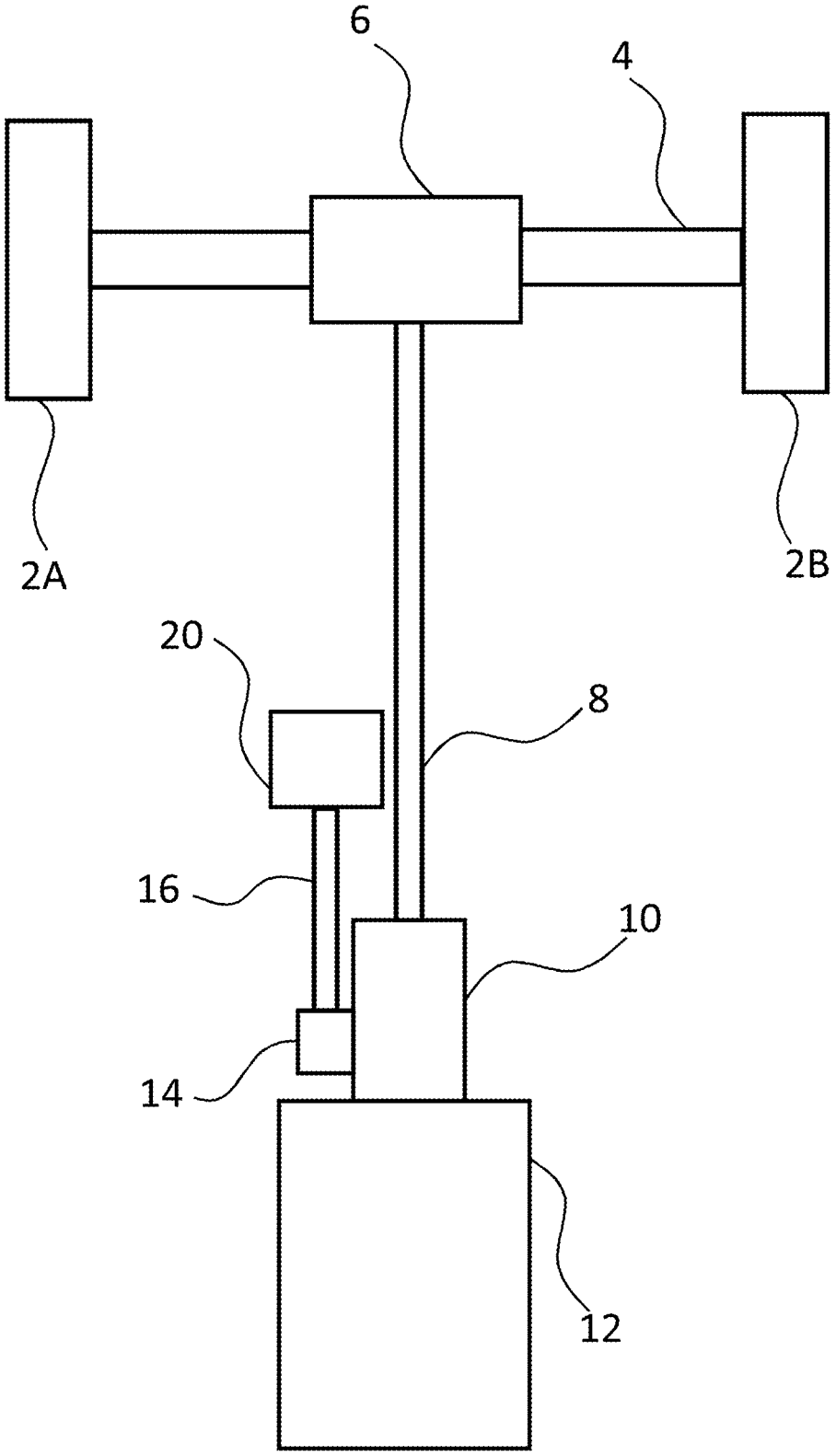
FIG. 1 is a simplified diagram of a hydraulic hybrid drivetrain of a vehicle.

FIG. 1 illustrates a vehicle drivetrain within which the invention can be employed. The drivetrain has a first wheel 2A and a second wheel 2B, an axle 4, a rear differential 6, a driveshaft 8, a gearbox 10, an internal combustion engine (ICE) 12, a power take off (PTO) 14, an intermediate shaft 16 and an electronically commutated hydraulic machine (ECM) 20. The intermediate shaft and gearbox are configured to transfer torque to one another via the PTO. The PTO is mechanically connected to the gearbox and typically contains at least two gears including a first gear in rotatable torque communication with a gear of the gearbox and a second gear which is non-rotatably secured to the intermediate shaft. The ICE functions as the prime mover, optionally driving the ECM and thereby the wheels, through the intervening drivetrain. The ECM may also be driven, for example, when carrying out regenerative braking.

As well as vehicles, the invention is useful in many other types of machines with drive trains, such as renewable power generation apparatus (e.g. wind turbines), injection moulding machines, hydraulically powered robots and so forth. The invention is also useful in non-drive vehicle applications such as refuse truck or forklift/digger hydraulics with the invention being used to control hydraulic actuators such as a compactor, crusher, boom or swing.

Figure 2:
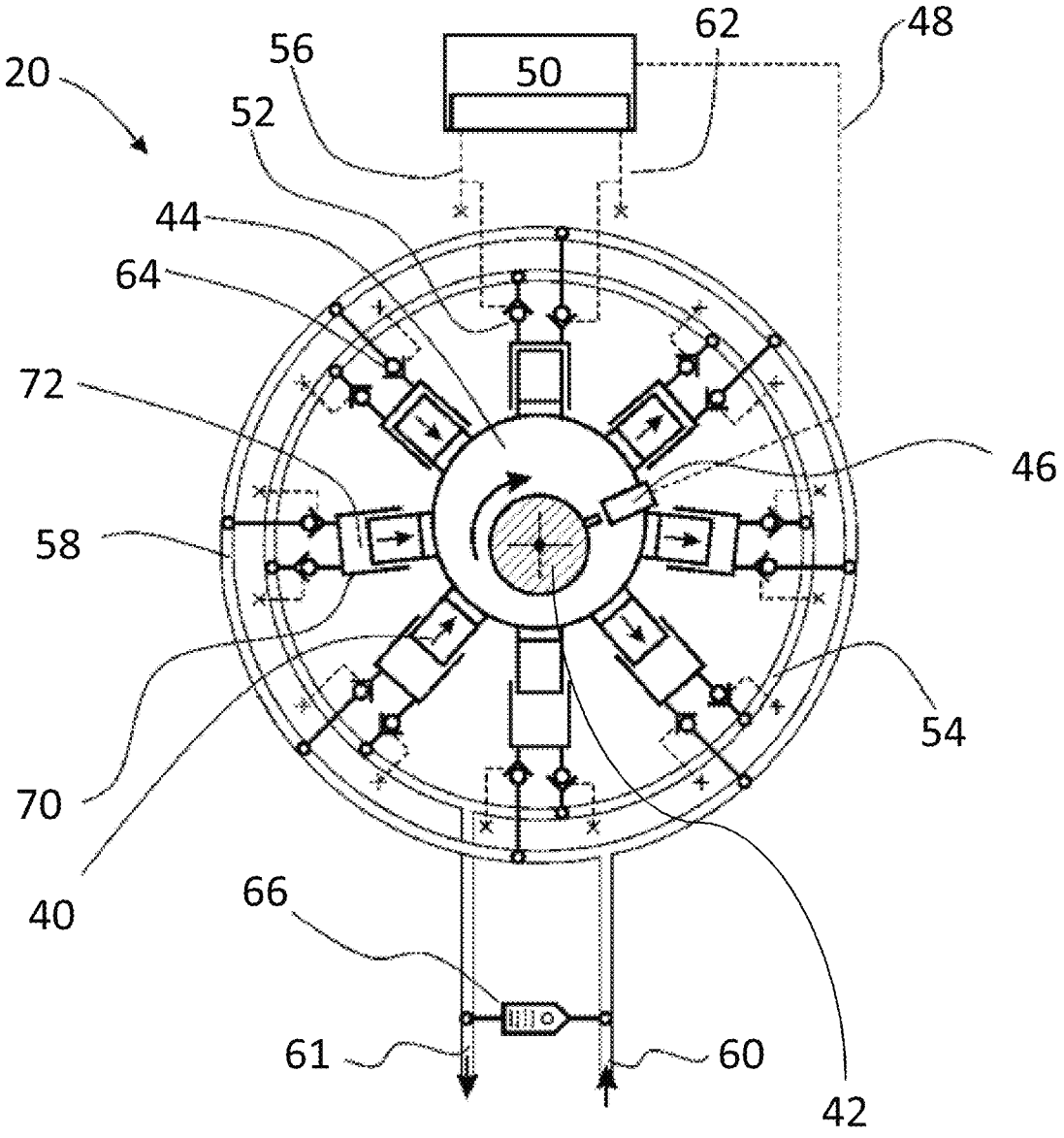
FIG. 2 is a schematic diagram of an electronically commutated machine.

FIG. 2 is a schematic diagram of a ECM 20 comprising a plurality of cylinders 70 which have working volumes 72 defined by the interior surfaces of the cylinders and pistons 40 which are driven from a rotatable shaft 42 by an eccentric cam 44 and which reciprocate within the cylinders to cyclically vary the working volume of the cylinders. The rotatable shaft is firmly connected to and rotates with intermediate shaft 16 and, when the gears are engaged, rotates in a suitable gearing ratio with axle 8. A shaft position and speed sensor 46 indicates the instantaneous angular position and speed of rotation of the rotatable shaft, communicating via a signal line 48, to the machine controller 50, which enables the machine controller to determine the instantaneous phase of the cycles of each cylinder.

The working chambers are each associated with Low-Pressure Valves (LPVs) in the form of electronically actuated face-sealing poppet valves 52, which have an associated working chamber and are operable to selectively seal off a channel extending from the working chamber to a low-pressure hydraulic fluid manifold 61, which may connect one or several working chambers, or indeed all as is shown here, to the low-pressure hydraulic fluid manifold 54 of the ECM 20. The LPVs are normally-open solenoid actuated valves which open passively when the pressure within the working chamber is less than or equal to the pressure within the low-pressure hydraulic fluid manifold, i.e. during an intake stroke, to bring the working chamber into fluid communication with the low-pressure hydraulic fluid manifold, but are selectively closable under the active control of the controller via control signals transmitted via LPV control lines 56 to bring the working chamber out of fluid communication with the low-pressure hydraulic fluid manifold. The valves may alternatively be normally closed valves.

The working chambers are each further associated with a respective High-Pressure Valve (HPV) 64 each in the form of a pressure actuated delivery valve. The HPVs open outwards from their respective working chambers and are each operable to seal off a respective channel extending from the working chamber to a high-pressure hydraulic fluid manifold 58, which may connect one or several working chambers, or indeed all as is shown in FIG. 2, to the high-pressure hydraulic fluid manifold 60. The HPVs function as normally-closed pressure-opening check valves which open passively when the pressure within the working chamber exceeds the pressure within the high-pressure hydraulic fluid manifold. The HPVs also function as normally-closed solenoid actuated check valves which the controller may selectively hold open via controls signals transmitted through HPV control lines 62 once the HPV is opened by pressure within the associated working chamber. Typically, the HPV is not openable by the controller against pressure in the high-pressure hydraulic fluid manifold. The HPV may additionally be openable under the control of the controller when there is pressure in the high-pressure hydraulic fluid manifold but not in the working chamber, or may be partially openable.

Arrows on the ports 61, 60 indicate hydraulic fluid flow in the motoring mode; in the pumping mode the flow is reversed. A pressure relief valve 66 may protect the hydraulic machine from damage.

With suitable control of the LPVs and HPVs in phased relationship with cycles of working chamber volume, the controller can control the net displacement (from the low pressure manifold to the high pressure manifold or vice versa) of each working chamber on each cycle of working chamber volume. Each working chamber may, on a given cycle of working chamber volume, undergo an active cycle with a net displacement of working fluid or an inactive cycle with no net displacement of working fluid. Active cycles can be pumping mode cycles, in which there is a net displacement of working fluid from the low pressure manifold to the high pressure manifold, driven by the rotation of the rotatable shaft, or motoring mode cycles in which there is a net displacement of working fluid from the high pressure manifold to the low pressure manifold (driving the rotation of the shaft). Inactive cycles can be achieved by holding a valve (typically the LPV) open throughout a cycle so that the working chamber remains in communication with a manifold throughout the cycle, or by keeping both valves closed. A decision is made on a cycle by cycle basis as to whether to carry out active or inactive cycles in order that the net displacement follow a target demand indicated by a demand signal. The demand signal may for example be a demand for a pressure of hydraulic fluid, or a flow rate of hydraulic fluid, or a total displaced volume of hydraulic fluid, or a power output, or the position of an actuator hydraulically linked to the hydraulic fluid etc.

In a pumping mode cycle, for example as taught by EP 0 361 927, the controller selects the net rate of displacement of hydraulic fluid from the working chamber to the high-pressure hydraulic fluid manifold by the hydraulic motor by actively closing one or more of the LPVs typically near the point of maximum volume in the associated working chamber's cycle, closing the path to the low-pressure hydraulic fluid manifold and thereby directing hydraulic fluid out through the associated HPV on the subsequent contraction stroke (but does not actively hold open the HPV). The controller selects the number and sequence of LPV closures and HPV openings to produce a flow or create a shaft torque or power to satisfy a selected net rate of displacement.

In a motoring mode of operation, for example as taught by EP 0 494 236, the hydraulic machine controller selects the net rate of displacement of hydraulic fluid, displaced by the hydraulic machine, via the high-pressure hydraulic fluid manifold, actively closing one or more of the LPVs shortly before the point of minimum volume in the associated working chamber's cycle, closing the path to the low-pressure hydraulic fluid manifold which causes the hydraulic fluid in the working chamber to be compressed by the remainder of the contraction stroke. The associated HPV opens when the pressure across it equalises and a small amount of hydraulic fluid is directed out through the associated HPV, which is held open by the hydraulic machine controller. The controller then actively holds open the associated HPV, typically until near the maximum volume in the associated working chamber's cycle, admitting hydraulic fluid from the high-pressure hydraulic fluid manifold to the working chamber and applying a torque to the rotatable shaft.

As well as determining whether or not to close or hold open the LPVs on a cycle by cycle basis, the controller is operable to vary the precise phasing of the closure of the HPVs with respect to the varying working chamber volume and thereby to select the net rate of displacement of hydraulic fluid from the high-pressure to the low-pressure hydraulic fluid manifold or vice versa, for example as taught by EP 1 537 333.

In some embodiments, there are a plurality of groups of one or more of the working chambers (coupled to the same shaft) which are connected to a respective plurality of high pressure manifolds (and thereby to sources or sinks of hydraulic fluid, e.g. hydraulic actuators or pumps). Each group may be controlled according to a separate demand signal for the respective group. In some embodiments, the allocation of working chambers to groups can be dynamically changed during operation, for example using one or more electronically controlled switching valves.

As is known from WO2011/104547 (Rampen et al.), the contents of which are incorporated herein by virtue of this reference, the precise phase of the opening or closing of the LPV or HPV may be optimised taking into account measurements made during earlier cycles of working chamber volume. For example the phase of the closure of the HPV may be optimised taking into account previous measurements of the timing of the phase of the opening or closing of the LPV or HPV. This leads to a default phase of opening or closing of the LPV or HPV. The controller will transmit control signals to the LPV and HPV at default phases in a default operating mode.

We have found that hydraulic machines of the type discussed remain vulnerable to cycle failure events. These may occur due to transient accelerations of the rotatable shaft, for example due to phenomenon such as backlash. Accelerations can be positive or negative (deceleration).

Causes of Transient Accelerations

By backlash (or lash) we refer to a clearance or lost motion in a (typically rotating) mechanism caused by gaps between the parts. It is the maximum distance or phase difference ('lash angle') through which any part of a mechanical system may be moved in one direction without applying appreciable force or motion to the next part in a mechanical sequence. An example, in the context of gears and gear trains, is the amount of clearance between mated gear teeth. Lash occurs either in a change in relative torque between parts, such that (continuing rotation in the original direction) the driving part and the driven part, have a reversal of roles. Or, when the direction of movement is reversed, then the 'slack' or 'lost motion' is taken up before the reversal of motion, or torque reversal, is complete. Backlash can also be quantified with a measure of the power transmission error resulting from backlash. Zero backlash means zero loss in power transmission. Even if a pair of components start their working life with little backlash between them, it is foreseeable that the level of slack or backlash will increase, and therefore it is useful for the control strategy to anticipate or simply compensate for this increase in slack between components, as well as overall changes in driveline backlash.

Lash at individual interfaces/connections adds together, thus compounding along the length of the driveline. Where multiple components are free to take-up lash between one another, this happens along the driveline length sequentially at each interface/connection. Thus, backlash events and transient accelerations may be short lived and potentially frequent.

It is worth noting that the gearbox ratio may influence the lash angle as seen by the ECM. Typically the higher the selected gear, the smaller the angle of lash. The differential (gears) in the driveline axle have some lash, and this differential in the same driveline along with the gearbox, thus together causing a certain degree (angle) of lash at the PTO (power take off). It is likely the degree of lash will be different in different gears. Thus, it is preferable to be able to deal with different degrees of lash.

Another potential cause of transient acceleration events arises from shaft windup. Shaft windup occurs in all rotating torque transmitting components to some extent. The driveline may comprise a number of shafts or shaft-like components, or components which transmit torque. Initial windup occurs where one end of a rotating component turns and the other end does not (or does not move through the same angle), due to internal torsional deflection of the shaft material. A torque is applied along the length of the shaft which will lead to windup under stress. In a sense, windup is position error, without torque error. When the torque is removed, the shaft member will 'unwind' thus removing the position error. Although windup is an important consideration in driveline members, backlash tends to have a far greater effect on shaft position error.

Considering machines with drivetrains as a whole, a component pair comprises a driving and a driven component. The driving component tries to go faster in one direction, providing driving torque. The connected component, termed the load or driven component, provides load torque. The drive component and load component may switch role, from an original first state to a new second state, with a corresponding switch from engagement of first engaging opposing surfaces, to second engaging opposing surfaces. The switch in engaged faces, and the reversal of energy flow, may be termed a 'torque reversal'. An example joint may comprise a cardan joint or splined interface between two components, or other such torque transmission mechanism.

A coupling may comprise two connected components with an interface between them: a first, and a second component which are torque-connected somehow (e.g. keyed together). Each component comprises at least one engagement surface. In the example driveline, the intermediate shaft and gearbox transfer torque to one another via the PTO. The PTO is mounted to the gearbox, and may contain a pair of gears: a first one of which meshes with a gear in the gearbox, and the second one of which is fixedly-secured to the intermediate shaft. The 1st gear may be the 1st component, and the 2nd gear may be the 2nd component. For Table 1, positive torque is motoring in the clockwise (CW) direction, or pumping in the counter-clockwise (CCW) direction:

TABLE 1 all possible states of engagement and non-engagement between 2 components

| State | Engagement of engage-able opposing surfaces | 1st component | 2nd component | Relative absolute Torque | Rotation direction |
|---|---|---|---|---|---|
| 1a | First pair | +torque 1 ('T1') | −torque 2 ('T2') | T1 > T2 | CW |
| 1b | Second pair | −torque 1 ('T1') | +torque 2 ('T2') | T1 < T2 | CW |
| 2a | Second pair | −torque 1 ('T1') | +torque 2 ('T2') | T1 > T2 | CCW |
| 2b | First pair | +torque 1 ('T1') | −torque 2 ('T2') | T1 < T2 | CCW |
| 3* | Not engaged | +/−torque 1 ('T1') | +/−torque 2 ('T2') | T1 & T2 adopt any value | Either |

*State '3': This third state is an in-between transient state in which the engagement surfaces do not engage. In this state, typically the first and second components may be said to be taking up the lash, travelling through their lash, or taking up the free movement until engagement of their respective first pair or second pair of surfaces. The period of this state is likely to be extremely brief.

Turning to the specific example of the hydraulic hybrid drivetrain illustrated in FIG. 1, Table 2 sets out possible driveline configurations.

TABLE 2 possible driveline configurations

| State (from Table 1) | ECM mode of operation | Gearbox mode | Nickname | Rotation direction |
|---|---|---|---|---|
| 1a, 2a | Pump | Driving | Braking/Regeneration | CW, CCW |
| 1b, 2b | Motor | Driven | Motor/Propelling | CW, CCW |
| 1a, 2a | Idle | Driving (driving the losses of the ECM) | Idling | CW, CCW |

There are a number of possible sources of backlash in hybrid transmissions using ECMs. There may be coupling lash due to non-ECM sources. Backlash may arise, either side of the coupling, from transient torque changes caused by a source other than the ECM. There may be coupling lash due to ECM mode switching, for example, from pumping mode to motoring mode and vice versa. This is further explained below. Transitions between modes may lead to coupling lash, and travel through this lash may lead to cycle failure.

In general, within a driveline having a coupling interface with a level of backlash, the contacting surfaces of that coupling travel through the backlash during certain mode transitions of the ECM. Travel through the backlash may occur at high frequency, which can itself disrupt control of the ECM. In this example, the ECM is connected to a rotating driveshaft (e.g. vehicle propshaft, vehicle PTO shaft, etc) having backlash in the various coupling interfaces. The combined inertia of the ECM, intermediate driveshaft, and the ECM side of the PTO is very low and thus high shaft accelerations may occur. High shaft acceleration may occur in the connected drivetrain, for example caused by backlash, shaft wind-up, general 'play' in mounts, and shaft oscillation.

Transient Accelerations, Cycle Failure, and Valve Timing

These transient accelerations (including in some cases negative accelerations) can lead to the previously described possible modes of cycle failure. The problem of avoiding cycle failure is affected by the time delay between the controller transmitting the control signal to actively control a valve and the actual subsequent opening or closing—and the duration of the opening or closing event. Transmitting the control signal may include starting a current through a solenoid, stopping a current (e.g. to allow a held open valve to close), reversing the direction of a current, varying the pulse width modulation of a current etc. The problem is also affected by the practical limitations of measurements of the speed of rotation of the rotatable shaft. For example, the position of the rotatable shaft may be detected when it has rotated by 360/n° where n is an integer. Interpolation can be used to monitor acceleration.

However, generally there will be a short lag in detecting sudden changes in acceleration changes between decision points.

To open or close a valve at a desired target phase, the opening or closing event is scheduled in advance taking into account the speed and position of the shaft at the point/time at which the scheduling process takes place. At the appropriate phase, the control signal is sent by the controller to the valve (in particular to the valve actuator which may be a solenoid). By the time that the valve actually opens or closes, subsequent acceleration/deceleration will cause the actual valve opening or closing phases to be inaccurate, for example because its time of opening or closing had been forecast making an incorrect assumption about shaft velocity.

This inaccuracy can cause cycle failure, for example, in the form of valve holding fail in which the solenoid of a valve fails to latch the armature in a particular state (associated with the valve being open or closed), or with the latch failing after the latch is initially made. Valve holding fail leads to a failure to fully pressurise a cylinder and so is an example of cycle failure. For example in a motoring cycle the LPV might close too late, just after TDC, with the effect that the HPV does not open at all, meaning the motoring cycle does not happen. Other types of cycle failure exist, for example the reverberation phenomenon mentioned above. Cycle failure is generally undesirable.

If all other factors (e.g. manifold pressure, fluid composition, temperature etc.) remain constant, the angle (phase difference) through which the machine shaft turns during the time it takes for the valve to respond to a control signal to close depends on the shaft rotation speed. LPV opening time (time between sending a signal to a valve to the valve opening) is relatively constant, irrespective of rotational speed of the machine. Thus, at higher speed, the machine will have passed through a greater angle than at lower speeds.

Valve timing is based on sampling of the phase and/or rotational speed measurements, and estimation of valve closing and/or opening times. There will be a delay due to processor lag, between the decision to actuate a valve and the valve being actuated. There is another physical delay between the solenoid of the valve being powered and the valve actually closing. If the shaft accelerates during these delays, there will be an error between the target and actual valve actuation phase.

Errors in the valve actuation phase may lead to displacement errors. The invention significantly reduces the impact of any error between target and actual valve actuation phase. During a motoring cycle these errors may for example be:

a) Actuating the LPV solenoid too late, leading to a valve holding failure and thereby cycle failure;

b) Actuating the LPV too early may mean that the cycle does complete but with a reduced output (below the displacement demand);

c) Turning off the HPV latching current too late, leading to a cycle failure with a reverberation phenomenon;

d) Turning off the HPV latching current too early, which leads to reduced output.

Error a) above is far more significant and potentially disruptive in comparison to error b) above. Error c) is also a highly significant, disruptive, and hence undesirable error.

During a pumping cycle these errors may for example be:

e) Actuating LPV closure too early may mean the pumping cycle fails completely;

f) Actuating LPV closure too late may mean simply a reduced output (below the displacement demand).

Some error in displacement is expected and is acceptable. For example, a small number of reverberation phenomenon strokes may be acceptable (depending on the application) and will not necessarily lead to total loss of control of the machine. However, if the reverberation phenomenon strokes continue, this may exacerbate the situation, triggering a positive feedback loop, leading to a total loss of control and total instability. According to the invention, preventative steps are taken which avoid this total breakdown from occurring, even at the cost of other factors (e.g. efficiency).

Typically, the default phase of opening or closing of the LPV and/or HPV depends on high pressure manifold pressure—especially the default phase of opening or closing of the HPV as the precise moment when it starts to open or close will depend on the pressure difference across the HPV. If there are gradual changes in the high pressure manifold, the controller can readily determine the correct default phase. However, transient pressure changes in the high pressure manifold may also cause cycle failure. For example, if the pressure in the high pressure manifold is higher than expected the HPV may open late, or not at all, after closure of the LPV in a motoring cycle, or the pressure in the working chamber after closure of the HPV may be too high in a motoring cycle, leading to a delay in opening or failure to open the LPV.

Figure 3:
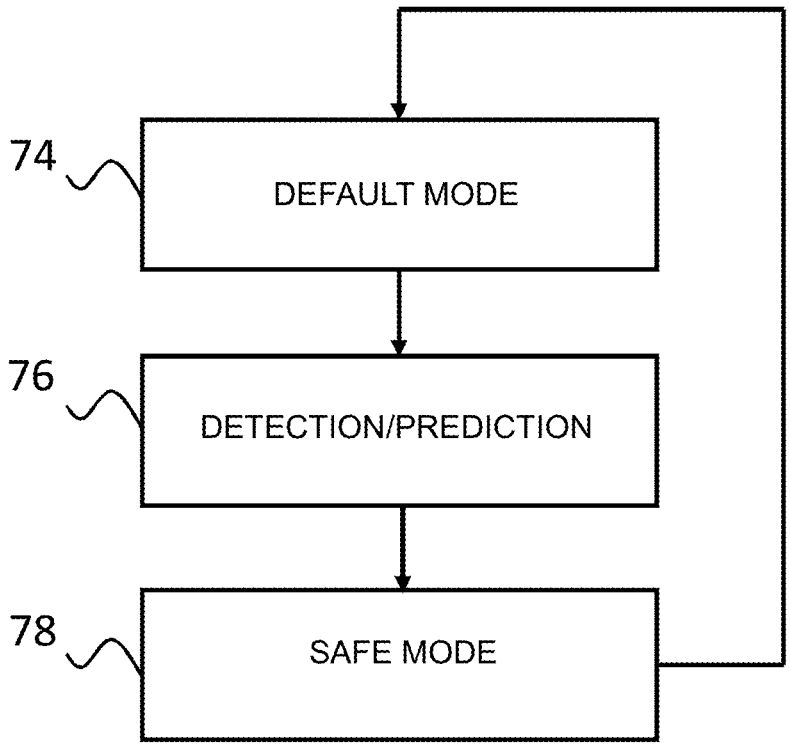
FIG. 3 is a flow chart of the general operation of an example embodiment of the invention.

According to the invention, as shown in FIG. 3, the timing of the opening or closing of the LPV and/or HPV is usually operated according to a default mode 74. The timing may for example vary with high pressure manifold pressure but in normal operation in the default mode, the opening or closing of the LPV and/or HPV takes place at a default phase of working chamber volume, chosen to maximise efficiency while remaining a margin away from a phase which would lead to cycle failure. A control signal or open or close the LPV and/or HPV is transmitted to the respective valve actuator at a phase which is calculated to give the intended valve opening or closing phase. Events associated with sudden accelerations of the rotatable shaft of the ECM, or transient pressure changes in the high pressure manifold, are detected (measured) or predicted 76 and, as a result, for a period of time, the active control of the opening or closing phase of the LPV and/or HPV is advanced or retarded (revised) as appropriate 78 to reduce the risk of or avoid cycle failure, albeit with a possible reduction in ADF and reduced efficiency. This is achieved by advancing or retarding the respective valve actuation control signal as appropriate. Then, after a period of time, the phase of opening or closing of the LPV and/or HPV, and the phase at which the control signals are generated, returns to the default phase.

There may be a default operating mode and a separate "conservative" mode in which the phase of the opening or closing of the LPV and/or HPV, and the phase of the control signals which cause these events are amended. In this conservative mode, the timing of the valve control signal(s) which cause the opening or closing of the LPV and/or HPV take place at an amended phase, which is advanced or retarded relative to the default phase.

The valve timing is therefore amended, from the default, by being advanced or retarded as appropriate. In the case of a working chamber carrying out a motoring cycle, the valve timing would be advanced; in the case of a working chamber carrying out a pumping cycle, the valve timing would be retarded. In either case, the swept angle through which the cylinder is pressurised is reduced. The reduced swept angle through which the working chamber is pressurised may have the effect of reducing overall torque or flow. This leads to a reduction in performance in comparison with default mode. ADF is reduced but losses stay similar. Although counter-intuitive, only ever using constant reduced volume strokes (rather than interleaving default mode active cycles with default mode inactive cycles) could have the effects of increasing noise, valve damage and torque ripple, and reducing torque level and energy efficiency, over the lifetime of the machine to which the hydraulic machine is applied. Hence, the conservative mode of operation ('conservative mode') in which the control signals are transmitted at the alternative phase, instead of the default phase, is used only selectively, and temporarily.

Although in these examples the phase of the control signal to open or close a valve is advanced or retarded (relative to a default) to cause the opening or closing of the valve to be advanced or retarded (as appropriate), the phase of the control signal to open or close a valve is advanced or retarded (relative to a default) which in some embodiments may, by no specific intention, cause the phase of the opening or closing of the valve to remain the same.

Deciding when to Activate Conservative Mode

In some embodiments, conservative mode (use of the alternative phase instead of the default phase) is triggered in response to the detection of an event associated with a transient acceleration, for example, detecting a spike in shaft rotation speed, receiving a signal indicating that a gear change is taking place or calculating from a mathematical model and the pattern of decisions as to whether working chambers undergo active or inactive cycles that there is about to be a change in the sense of the forces acting on the rotatable shaft.

In some embodiments, conservative mode of operation, using the amended phase, is triggered using feedback control, for example in dependence on one or more of the following factors:

- sensed shaft acceleration. i.e. a single acceleration/change in shaft rotation speed,
- sensed oscillation of the shaft. i.e. multiple speed changes/accelerations constituting an oscillation event,
- sensing that the shaft exceeds a range of peak to peak shaft speeds over a time period,
- sensed/measured pressure (especially if in a stiff hydraulic system),
- sensed/measured torque or flow,
- a measured start time or phase of valve opening or closing (as determined by a user or by the controller),
- measured clutch slip exceeding a threshold.

The above detected factors may have been caused by cycle failure(s), or they may have been caused by external driveline components or external hydraulic components. In addition, cycle failure may be directly detected by the electronically commutated machine controller, for example, by detection of the timing of movement, or otherwise, of valves, which can be determined for example by monitoring current in valve solenoids. Conservative mode of operation may be triggered directly based on this detection.

The conservative mode may also be triggered in response to detection of an oscillating pressure in the high pressure manifold.

Alternately, in a feedforward embodiment, the controller schedules or triggers conservative mode dependent on events such as:

- a prediction that shaft torque ripple will to come in to resonance with a (learned or anticipated) vibration mode of the coupled system. For example, if the controller knows the system is in gear X, the vehicle speed is Y and the ECM is about to perform motoring at displacement fraction Z, then the controller responds by implementing conservative mode, or
- an anticipated step change of the ECM torque due to discontinuous displacement demand or some other change of displacement demand (e.g. change from idle to a quarter displacement), or
- a step change of the coupled drivetrain system affecting the inertial load, or damping, for example receiving data indicative that the engine is de-clutching, or there is a gear-shift, or
- detecting that the ECM control algorithm will trigger a pattern of working chamber selection decisions (the pattern of whether consecutive working chambers carry out active or inactive cycles) associated with higher peak-to-peak ripple. This is especially relevant e.g. at low displacements where there may be spaced active mode cycles, thus defining longer periods of zero pressure/torque pulses interspersed infrequently with associated pressure/torque pulses arising from the active mode cycles.

In respect of the first of these points, it may be that the shaft vibration is mainly encountered at resonance between ECM torque ripple frequency (which is a characteristic frequency arising from the ECM) and the natural modes of vibration of the shaft (frequencies which cause strong vibration of the shaft). Simply put, when the excitation frequency of the ECM matches a natural frequency of the shaft (or other parts of the driveline), undesirable resonance occurs giving large sinusoidal accelerations of the rotatable shaft.

Resonant frequencies can be learned by detecting when resonances occur and building up a table of estimated shaft modes by statistical correlation between estimated shaft ripple frequency and the activity of the feedback system.

Ripple and resonance may be due to a known driveline oscillation resonant frequency or set of frequencies. Detection of speed ripple may be aided by filtering the shaft speed signal with filters configured to selectively boost the detection of known frequencies, and to reject other frequencies. Conservative mode may then be applied selectively with respect to the known resonant frequencies (e.g. only 30-50 Hz).

In some applications, there will be no or only limited information initially available about frequencies which will cause unwanted oscillations. For example, although the hydraulic machine may be fully tested, optimised and programmed it may be attached to the drive train of a new machine. In this case, the frequencies are static but unknown. The feedback system can be used to build up a table of frequencies which cause undesirable oscillations by analysing the correlation between estimated dominant shaft ripple frequency (determined by the pattern of selection of working chambers to carry out active or inactive cycles, and by the shaft speed of rotation) and the actual activity of the feedback system (e.g. size of feedback signal). For example, every time the conservative operating mode is activated it may increment a counter in a table. This table can then be used to build up a record of which frequencies of selection of working chambers to carry out active or inactive cycles caused an oscillating shaft response (leading to use of the conservative mode). This information can then be used to proactively engage the conservative mode when generation of those frequencies is again predicted (based on the displacement demand, Fd, and speed of rotation of the rotatable shaft).

Furthermore, the frequencies which may cause oscillations may vary during operation of the machine (e.g. when the clutch is depressed or in different speed ranges). In an example a vehicle has a first, lower speed, mode and a second, higher speed, mode, with different shaft dynamics in each. In this case, the controller may monitor the effectiveness of the advancement or retarding of the control signal and subsequently increase the phase difference between the amended and default phases if the current phase difference is not effective. Effectiveness can be monitored by measuring how frequently the conservative mode (e.g. variable continuous conservative mode) acts. If the conservative mode is actuated frequently (e.g. more than 10% of the time) then greater advancement or retarding of the control signal is required.

Feedforward can also be used to trigger the conservative mode when an event causing a transient change in high pressure manifold is predicted.

Figure 4:
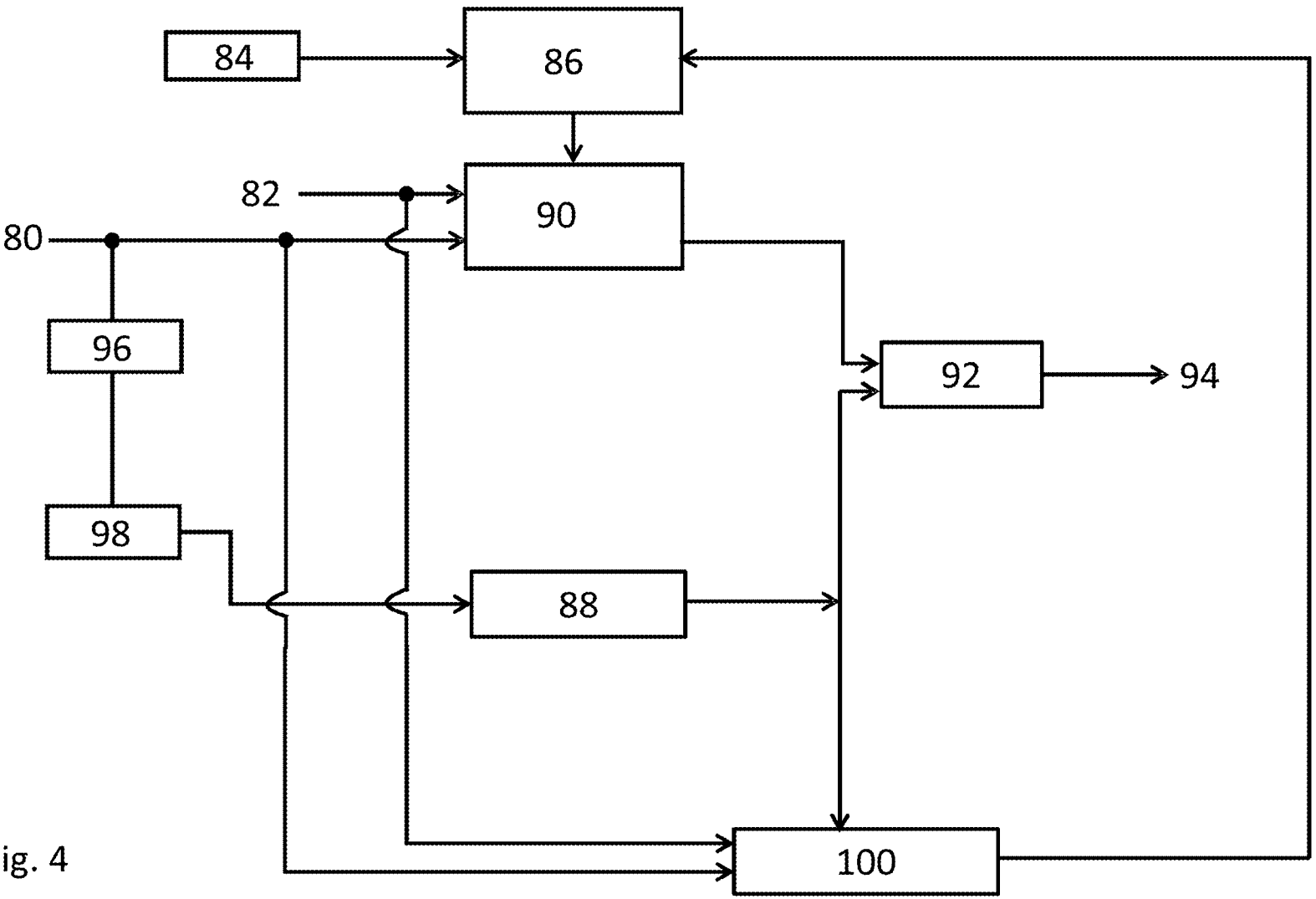
FIG. 4 is a flow chart for deciding the phase of valve advancement or retardation due to conservative mode.

FIG. 4 is a flow chart of a procedure according to the invention by which the controller makes the decision regarding whether or not (and if so when) to activate conservative mode, or to deactivate conservative mode and return to the default mode of operation. The controller processes inputs including the shaft speed (e.g. as RPM) 80 and a demand signal, for example a displacement demand fraction, Fd 82. By the displacement fraction, Fd, we refer to the fraction of the maximum displacement per revolution of the rotatable shaft of the ECM. The controller includes a database, here a fixed table 84 containing mode frequencies 86. The method allows the implementation of both a feedforward implementation of conservative mode 90 and a feedback implementation of conservative mode 88 (one skilled in the art will appreciate that in some embodiments it may be more appropriate to only implement either feedforward conservative mode or feedback conservative mode).

In the feedback aspect, both the shaft speed and the demand fraction, Fd, are input and are compared to a maximum allowable degree of fluctuation 92, conservative mode 94 being activated only when the RPM fluctuates above this. For the feedforward aspect of conservative mode, the measured RPM is filtered using a filter 96 and the filtered measurement of RPM is amplified using an amplifier 98 before it is determined whether the RPM is fluctuating beyond the maximum allowable degree of fluctuation. If this is the case, a machine learning module 100 also receives the filtered, amplified measurement of RPM and the demanded Fd to calculate the frequency at which this occurred, and this frequency will be added to the mode frequencies 86 table 84. This allows the system to mitigate the resonance when the same conditions (including, RPM, Fd) are subsequently re-encountered. This has the advantage that a resonant mode can be predicted and attenuated pre-emptively and hence more effectively.

Thus, measurements of resonance obtained from the feedback control can be used to build the database of operating parameters during which resonance may take place used in the feedforward system.

To summarise, feedback conservative mode waits for resonance to build up, detects this and activates conservative mode in order to attenuate the amplitude of the resonance. Feedforward conservative mode learns the response of the system and then pro-actively actuates conservative mode to mitigate the resonance before it can build up. Furthermore, the transition from default to conservative mode can be controlled using a combination of feedback and feedforward modes. In the case, of the embodiment of FIG. 4 this can be triggered by the maximum of the two outputs.

Conservative Mode Triggered by Machine Mode Transitions

As described above, backlash may occur due to changes in the direction of the torque exerted on the drive train. The controller may analyse the pattern of decisions as to whether consecutive working chambers carrying out active or inactive cycles, and motoring or pumping modes, and if required model the response to the drive train, to thereby determine when backlash is about to occur, and trigger conservative mode.

The following table simplifies the various engagement states of the couplings within a transmission (relative to tables 1 and 2 above):

TABLE 3

| Mode number | Nickname | DD mode of operation | Gearbox mode | Torque at the PTO |
|---|---|---|---|---|
| 1 | Idling | Idle | Drive | Negative |
| 2 | Braking/regen | Pump | Drive | Negative |
| 3 | Assisting torque input/propel | Motor | Driven | Positive |

In the context of a (vehicle) transmission, the power take off (PTO) is the general label of the part containing the engagement element between the ECM and the driveline of the transmission.

Some working chamber mode changes cause backlash, and the most likely to cause lash are described in detail below. At the moment of switching mode (e.g. from pumping to motoring or vice versa, or from idling to motoring or vice versa), there is a transition from an 'interface-engaged' state (clutch closed, thus connecting the driveline and vehicle inertia) to an 'interface disengaged' state (clutch open, thus disconnecting the driveline and vehicle inertia), the ECM shaft and rotating components may then undergo very rapid acceleration (promoted by the low inertia of the driveline). By idling we refer to carrying out predominantly or entirely inactive cycles with no net displacement of working fluid.

Changes between idling and pumping, or vice versa, are less likely to cause high shaft accelerations than changes between idling and motoring, and vice versa, or between pumping and motoring, and vice versa.

For example, with reference to Table 3, changing from mode 1 (idling) to mode 3 (propel, i.e. motoring) results in the coupling passing through its free movement (lash), and then switching-in the engagement side of the lash, can cause substantial accelerations, where conservative mode is advantageous. The reverse change is usually less problematic as when idling there is no actively controlled torque on the shaft provided by the ECM and so no instability can be caused by high shaft acceleration.

The change from mode 2 (braking, i.e. pumping) to mode 3 (propel, i.e. motoring) also cause substantial accelerations. The reverse change usually leads to lower accelerations as pumping is more tolerant to valve phase error, but conservative mode may still be advantageous.

However, backlash can also occur without reversal of the ECM torque direction if there is a reversal of torque elsewhere in the drive train, for example a sudden increase or decrease in motoring or pumping displacement of the ECM may cause a coupling to pass through its free movement due to inertia in the driving or driven load.

With reference to FIG. 1, the higher the shaft acceleration, whether driven by the ECM or by the wheels, through the 'lash region', the harder it is for valves to commutate correctly, leading to a higher chance of reverberation phenomenon or valve holding failure, thus leading to a mismatch with displacement demand or possibly to system instability. Acceleration of axle 4 is itself is not an issue. The problems arise if there is high acceleration of the intermediate shaft 16 and/or ECM shaft 42 (shown in FIG. 2).

The controller may predict accelerations, and as a result enable conservative mode, for example by:

- referring to a table which lists patterns of cylinder selection (patterns of selection of active or inactive cycles), and whether or not the resulting torque will be discontinuous, or
- by employing a model-based algorithm, which predicts the torque waveform and acts to initialise conservative mode or to schedule it to coincide with the operating points when discontinuous torque is predicted to occur.

Valve Timing Changes During Conservative Mode

By advancing the timing (when implementing conservative mode while motoring) we refer to causing the respective valve to open or close (as appropriate) in advance of (i.e. earlier than) its usual, default phase. This results from transmitting the control signals at the alternative phase instead of the default phase.

This advanced timing may for example mean; while motoring:

- the LPV is closed earlier than normal before TDC, typically by advancing 'LPON angle', the phase at which the current to the LPV is switched on/increased, thus closing the LPV), and/or
- the HPV is closed earlier than generally it would otherwise be, at a phase further than normal in advance of BDC. Advancing HPOFF angle (the phase at which the HPV solenoid current is switched off, or reduced, thereby de-actuating the HPV and allowing (causing) the HPV to close passively by the action of a spring etc.). The average torque/flow is reduced in proportion to the amount of conservative mode applied.

In the context of pumping mode of the DD machine, retarded timing may mean:

- the LPV will close later than normal around BDC (the HPV will consequently open later, which is a passive result of delaying the LPV timing).

Figure 5:
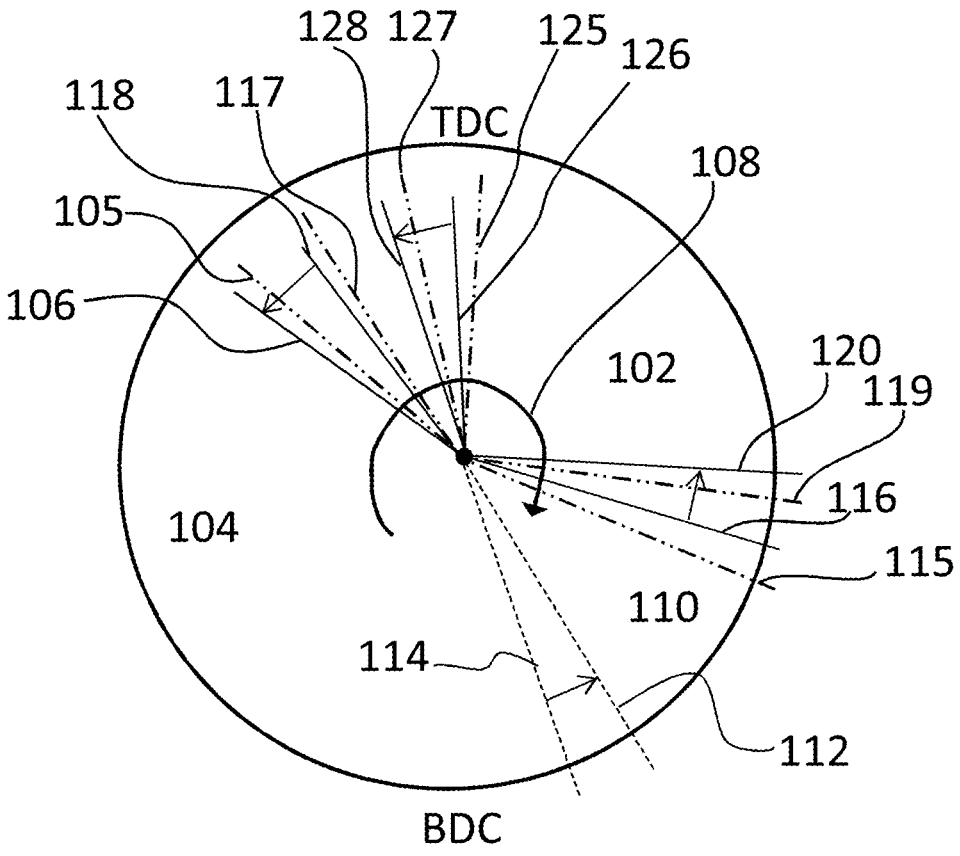
FIG. 5 is a timing diagram for an example embodiment of the invention when motoring, illustrating the phase of key events within a cycle of working change volume.

In more detail, FIG. 5 is a timing diagram, indicating a cycle of working chamber volume as a piston reciprocates within the working chamber in a motoring mode. The direction of rotation is shown with arrow 108. TDC and BDC label top dead centre and bottom dead centre respectively. The cycle has a motoring period 102 in which pressurised fluid is received from the high pressure manifold and an exhaust stroke 104 in which pressurised fluid is vented to the low pressure manifold.

In a motoring cycle, shortly before TDC, the LPV is closed, under the active control of the controller. In default mode a control signal is transmitted to close the LPV at phase 117 (a default phase) and the LPV closes shortly thereafter at phase 118. In conservative mode the LPV closure signal is transmitted at phase 105 (an alternative phase) and the LPV closes at phase 106.

The closure of the LPV traps working fluid in the chamber and pressurisation from the piston motion enables opening of the HPV, starting the pressurised motoring period, at phase 126 in default mode in response to the transmission of a preceding control signal transmitted at phase 125 (default phase). In the conservative mode, the HPV opening control signal is advanced to phase 127 (alternative phase) leading to the opening phase 128 of the HPV also being advanced.

Thereafter, towards the end of the contraction stroke of the working chamber, a control signal transmitted at phase 115 (default phase) precedes the high pressure valve being actively closed at phase 116 in default mode. Similarly in the conservative mode, the HPV control signal is transmitted at phase 119 (alternative phase) which precedes the closure of the HPV at phase 120, both of which are advanced relative to default mode phases. Pressure in the working chamber drops rapidly as the trapped fluid expands and this enables the LPV to open passively (indicated by the dashed line) at phase 114, which is advanced to phase 112 in conservative mode.

In this example, the phase of each valve opening or closing event has been advanced, although this is not essential and it may be that only some, or just one valve opening or closing event is advanced (or retarded in the case of pumping cycles).

In practice the valve opening and closing phases shown in FIG. 5 are target phases. The actual phase of opening or closing may differ due to unexpected accelerations or changes of pressure in the high pressure manifold.

Figure 12:
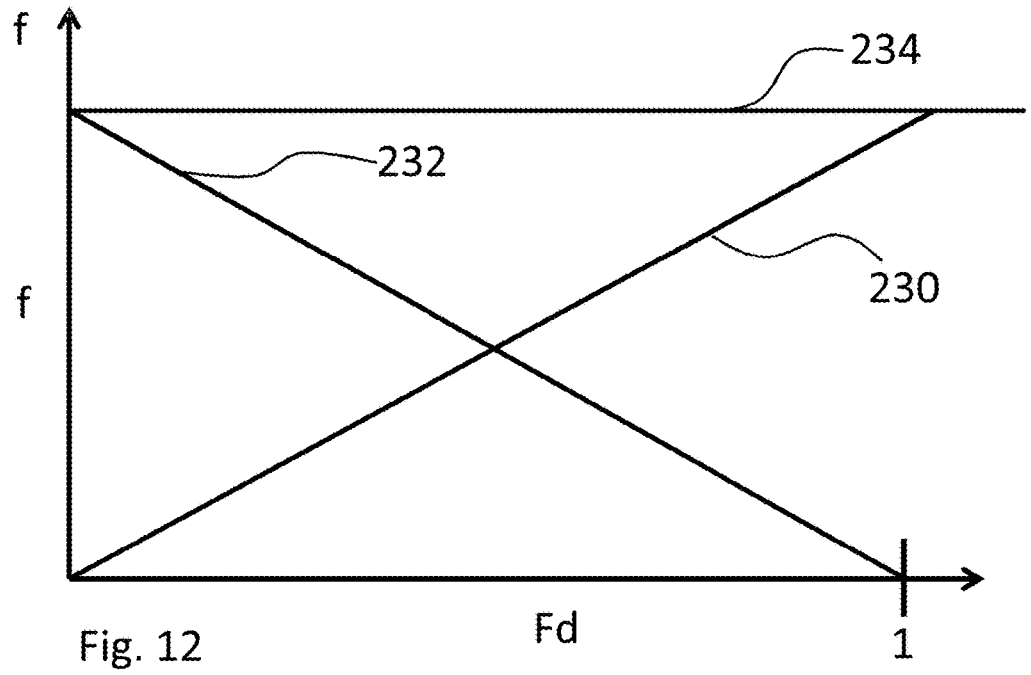
FIG. 12 is a plot indicating the main frequency of ripple per revolution as a function of Fd.

The extent to which the phase is revised relative to default mode timing may be fixed or variable. The phase advance may be binary (and so either taking place or not) as shown in FIGS. **6*a*-6*e*, or continuously varying (as shown in FIG. 12**).

Figures 6A, 6B, 6C:
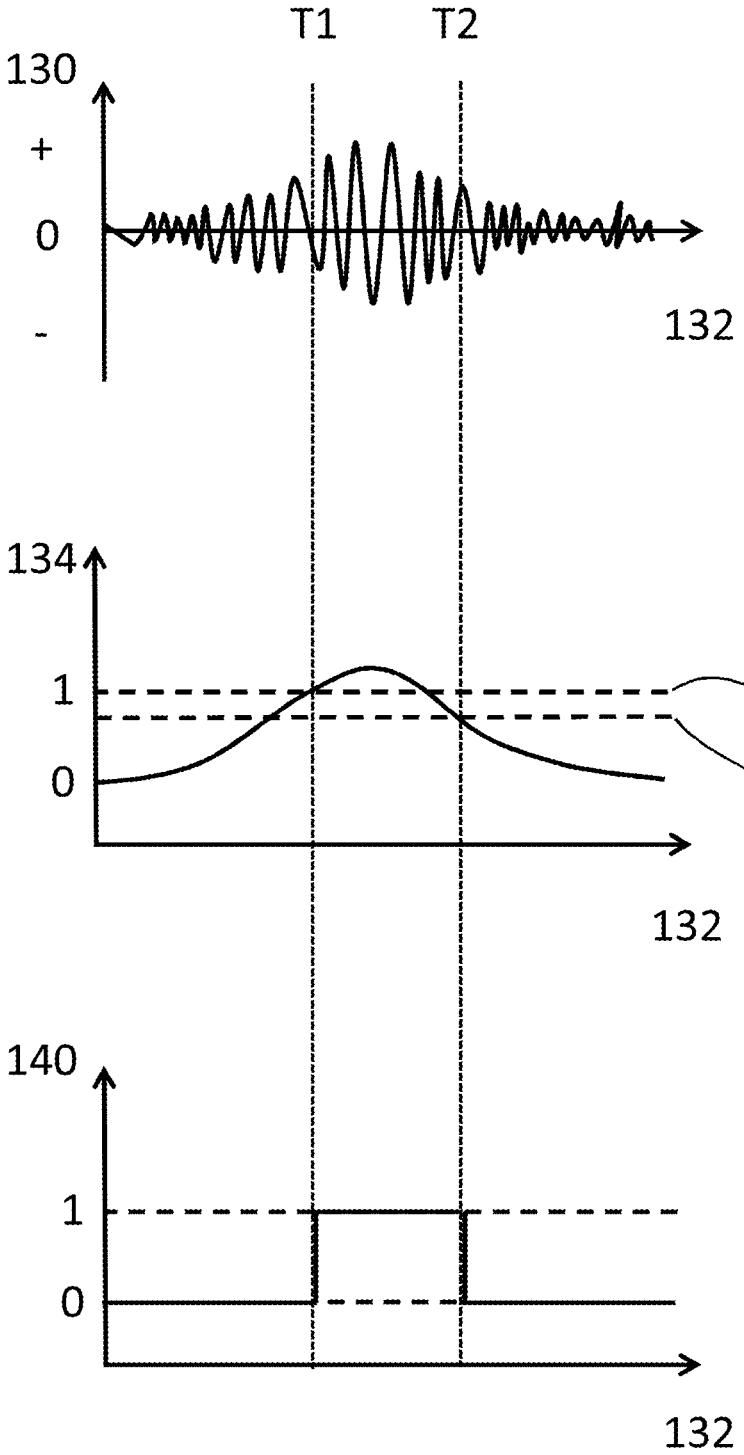
FIGS. 6*a*-6*e* are plots of behaviour of a fluid working machine operating in binary conservative mode, with hysteresis.
Figure 6D:
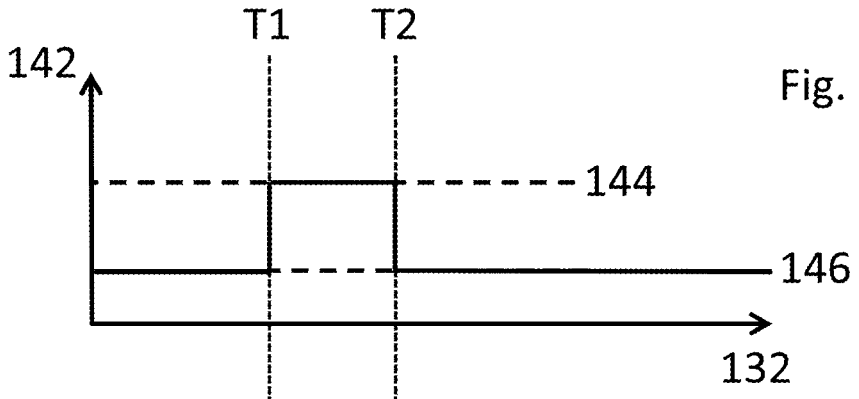
Figure 6E:
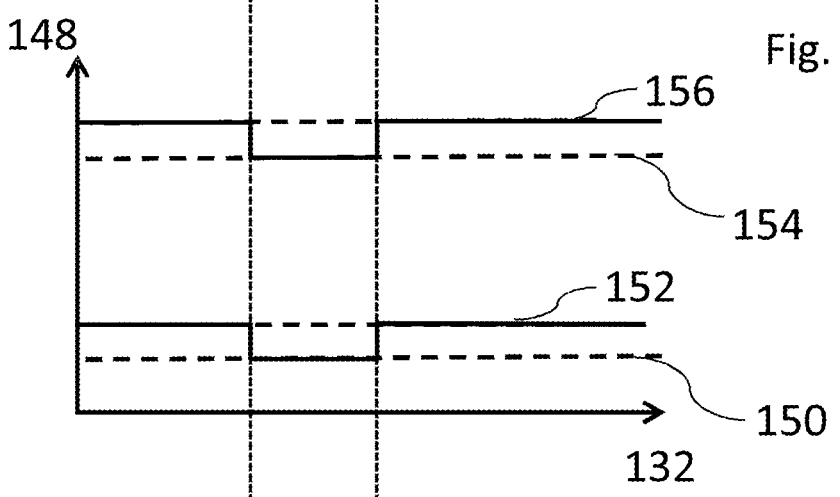

FIGS. **6*a*-6*e* are a series of plots of working machine behaviour, the machine operating in binary conservative mode, with hysteresis. FIG. 6*a* is a plot of shaft speed AC component 130 as a function of time 132, and includes decision points at T1 and T2 where the decisions are made to respectively start conservative mode and to stop conservative mode and return to default mode. FIG. 6*b* is a plot of peak-to-peak of shaft speed AC component 134 as a function of time, wherein the function enters conservative mode threshold 136, (defined as a peak-to-peak value of the shaft speed AC component above which conservative mode will be activated) and leaves conservative mode threshold 138 (defined as a peak-to-peak value of the shaft speed AC component below which conservative mode will be deactivated). FIG. 6*c* is a plot of when conservative mode 140 is activated (where 1 indicates that conservative mode is active and 0 indicates that conservative mode is not active), as a function of time. FIG. 6*d* is a plot of valve advance 142 as a function of time, where the valve advance varies between maximum valve advance 144 and zero valve advance 146 in response to the activation (or deactivation) of conservative mode. FIG. 6*e* is a plot of valve movement phase, the bottom trace for the LPV and the upper trace for the HPV, in degrees° and labelled 148, as a function of time. 130° is the advanced LPV on angle (150), 140° is the default LPV on phase at which the LPV is open (152), 210° is the advance HPV off phase (154), and 220° is the default HP off phase at which the HPV is closed (156**).

Figure 7:
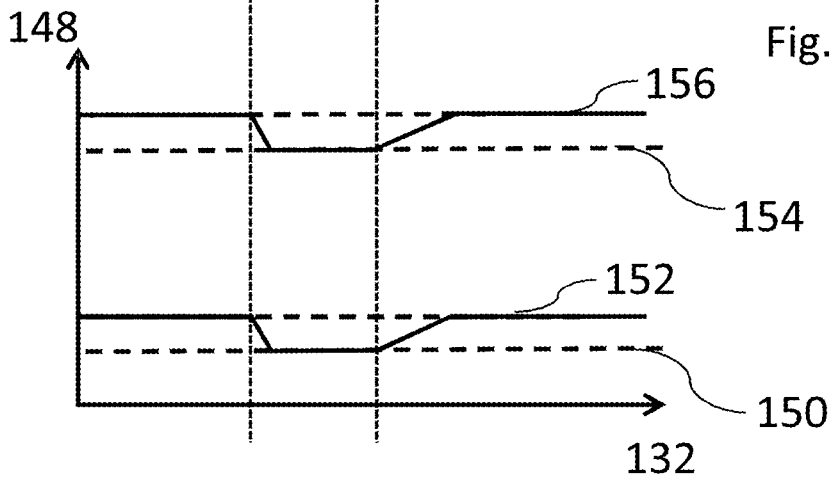
FIG. 7 is a plot of behaviour of a fluid working machine with binary conservative mode with hysteresis and ramp rates, where the ramp rates are asymmetric.

From FIGS. **6*a*-6*e* the activation, deactivation and the effect of applying conservative mode may be further understood. In FIG. 6*a* the shaft speed AC component 130 oscillates over time 132. FIG. 6*b* is a plot of the peak-to-peak speed AC component 134 as a function of time. At time T1 the peak-to-peak of the shaft speed AC component has increased above a conservative mode upper threshold (136), and breaching this threshold specifically causes conservative mode to be activated. As a result of conservative mode being activated, as can be seen in FIG. 6***d*, the valve advance (142) is set to maximum (144), such that both the LPV and the HPV are activated some phase angle before they ordinarily would be in the cylinder cycle, as indicated in FIG. 6*e*. Returning to FIG. 6*a*, this subsequently causes the amplitude of oscillation of the shaft speed AC component to reduce. At time T2 the peak-to-peak of the shaft speed AC component has been reduced to the point where it is below the conservative mode lower threshold 138, causing conservative mode to be deactivated, then the shaft speed oscillation continues to reduce naturally. The valve advance time is reset to zero valve advance 146 and both the LPV and the HPV are activated at the normal timing for default mode. Operating in discrete conservative mode may also have time/phase based ramps or rate limits applied to valve actuation phase so as to avoid sudden steps of torque or flow, as shown in FIG. 7. FIG. 7 demonstrates it is possible to have different ramp rates for entering and for leaving conservative mode. FIG. 7 shows the change from maximum valve advance to zero valve advance over a longer time period than from zero to maximum.

The binary conservative mode of FIGS. 6*a*-6*e* is especially useful where the controller needs to quickly change to advance the timing, for example in anticipation of or during sudden acceleration of the shaft. In contrast, in a second example embodiment a continuous variable implementation of conservative mode is explained with reference to FIG. 12.

The magnitude of the advancement (when motoring) or retardation (when pumping) of valve timing typically depends on the respective trigger for conservative mode. The controller may store a current phase difference between conservative mode and default mode, for example 10°. It may be different for different valves.

In conservative mode, the phase value(s) of the valve opening or closing may be set in the ECM controller, or in another controller, which communicates the value to the electronically commutated machine controller via serial communication or otherwise.

In different embodiments, the value of one or more of the valve opening or closing phases in conservative mode may:

- depend on the reason for the measured or predicted cycle breakdown which triggered conservative mode. A set or standard 'large response' (i.e. larger degree of advancing/retarding timing) is needed where a reverberation phenomenon is the trigger for conservative mode. In these cases, the phase advance should be relatively large.
- depend on the influence which conservative mode would have, for example may depend on the change in efficiency or capacity of the machine arising from the switch to conservative mode. For example, the phase advance of the solenoid current to cause the LPV to close could be increased until the ADF reduces by 5%. Or, the phase advance of the HPV solenoid current being switching off to enable the HPV to open during a motoring cycle could be increased until the ADF reduces by 5%,
- depend on the effect that applying conservative mode has on the torque and/or pressure ripple, for example it may be in proportion to a measured feedback signal
- depend on the type of event (e.g. for a gear shift, or a step change in displacement demand).
- be calculated continuously as a function of an operating parameter, such as a measured amount of shaft acceleration or oscillation.

Figure 14:
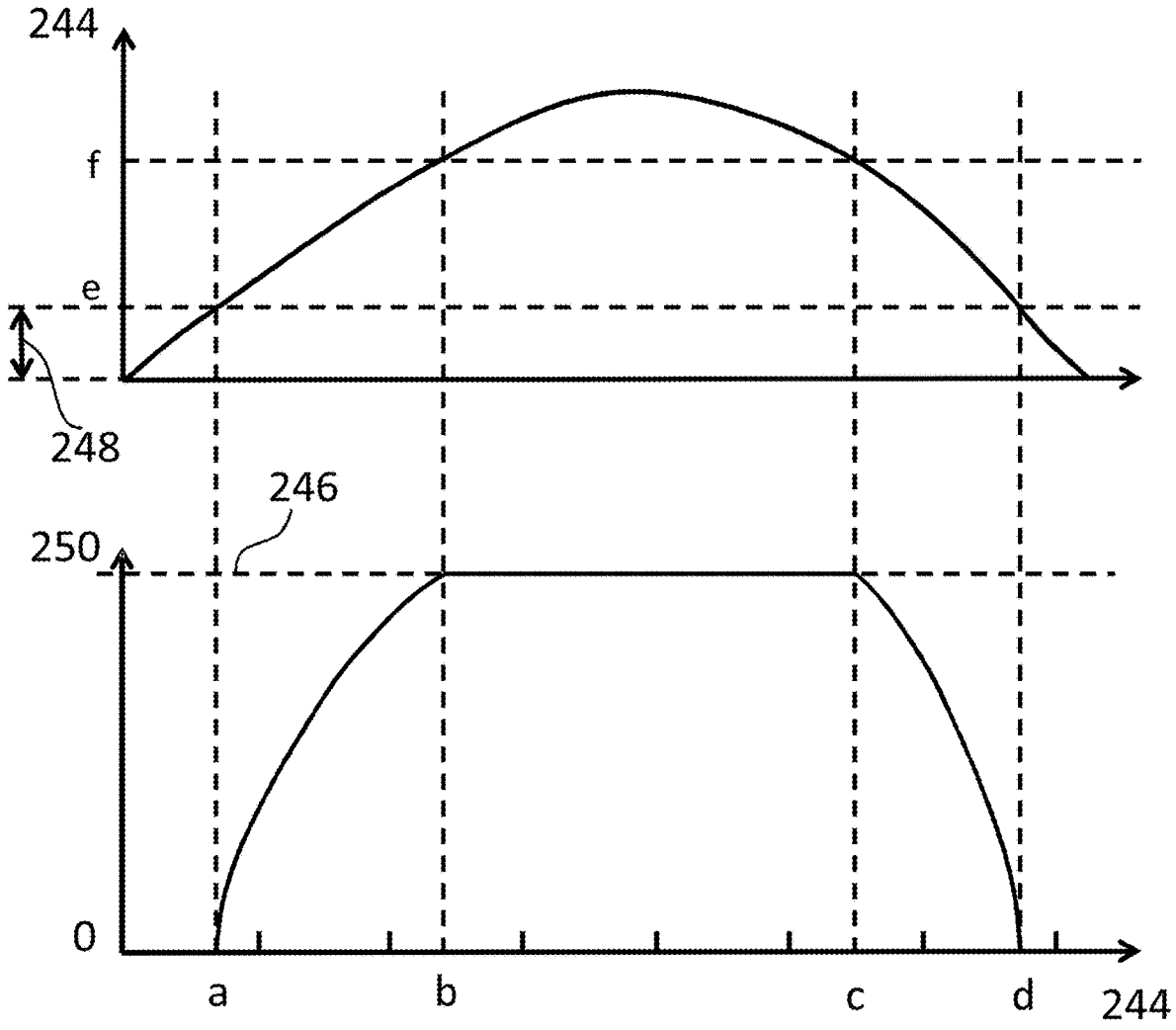
FIG. 14 shows a pair of plots of behaviour of a fluid working machine with continuous or proportional conservative mode.

With respect to this last option, FIG. 14 is an example as to how valve advance 250, for either LPV or HPV, may be varied up to a maximum phase advancement 246 in proportionate continuous response to a shaft oscillation with a measured peak to peak AC signal (244). 248 is a range, defined between 0 and level 'e' AC signal, within which there is some oscillation but it is tolerated without the use of conservative mode.

In respect of either the LPV or HPV timing, the phase advancement may need to be limited since at some magnitude of the advancement, the torque ripple will reach an extreme (possibly even applying a negative torque), which may in itself increase transient acceleration of the shaft. This effect will be more pronounced at low displacements, when flow is more pulsatile.

This continuous mode may be advantageous over discrete mode in only applying the necessary degree of conservative mode for a given shaft oscillation, and avoiding sudden steps of torque and flow due to the valve advancement.

Return to Default Mode

There is typically some flexibility over returning to default mode. The controller may for example return the valve timing back to the default timing, changing from conservative to default mode, after a period of time, or predetermined number of shaft rotations, or in response to measured operating parameters, for example, a measurement that the peak to peak shaft speed variation has dropped to below a threshold, indicating that a resonance has been suppressed, or that valve reopening phases are within a predetermined range or the pressure oscillation in the high pressure manifold is below a threshold. The period of time, or number of shaft rotations may be dependent on the trigger for conservative mode and may be learned over time.

The return to the default timing may take place from one working chamber cycle to the immediately following working chamber cycle, giving a step change, or gradually, for example with ramp down. The controller may enter conservative mode in the discrete step fashion of FIGS. 6*a*-6*e* but return to default mode gradually using the discrete conservative mode with hysteresis and ramp rates method of FIG. 7. In contrast, in a situation where the shaft speed approaches a range within which resonance may occur, it may be preferable instead to both enter and exit conservative mode using the discrete conservative mode with hysteresis and ramp rates of FIG. 7, thus ensuring smooth operation.

In some embodiments, the phase difference between the alternative phase and the default phase may be calculated as a continuous variable which is derived from (e.g. proportional to) a measured shaft speed variation, possibly with the application of a slew rate limit. A slew rate limit on the valve advance can ensure that the phase of valve actuation does not change too quickly. This regulation reduces the chance of the very steps to mitigate excess vibration themselves being the cause of excitation or increased vibration. However, the faster the slew rate the quicker change of valve opening or closing phase, and thus the sooner normal timing can be resumed in order to return to valve timing associated with peak efficiency.

The transition from conservative mode back to default mode may also occur after a period of time determined to ensure take-up of play along the driveline has happened, or once it is determined that re-engagement has occurred (for example from the shaft speed or by a reduction in the AC component of the speed variation of the shaft, or using contact sensors). Once take-up of play along the driveline has occurred, conservative mode can be reduced so that valve timing advancement or retardation (relative to default mode) is reduced, or the controller may simply return directly to default mode.

The amount of backlash may be determined by measuring the error between expected and actual shaft position at specific times during mode transitions (e.g. from pumping to motoring) which may cause backlash. The learned error may be used to set the amount of phase advance or retardation to apply to valve opening or closing timing in conservative mode.

More about Vibration Modes

As described above, one of the circumstances in which conservative mode is useful is to avoid resonance effects. Operating parameters which cause resonance can be learned, enabling later predicting of resonance. Resonances arise from patterns of selection of cylinders to carry out active or inactive cycles. For example, if the demand is for 10% of the maximum displacement, it may be that every $10^{th}$ working chamber to reach a decision point will undergo an active cycle and the rest will not, leading to a resonance effect with a period equal to the time difference between the decision points of every $10^{th}$ working chamber. Note that it is more efficient to intersperse active and inactive cycles in this way, than to cause each working chamber to output 10% of its maximum displacement volume, despite the resonance effects.

With reference to FIG. 12, the frequency (f) of cylinder activations 230 increases with displacement fraction (Fd). Repeating patterns of cylinders carrying out inactive cycles can also generate resonances, especially at high Fd and the frequency of cylinder deactivations 232 decreases with displacement fraction.

The resonance effects create particular problems if there are other components of the machine with corresponding resonant frequencies. It is notable that the actual frequency of the resonance effect is proportional to the speed of rotation of the rotatable shaft, which must also be taken into account. The decision frequency is the number of revolutions per second multiplied by number of cylinders (or decision points, often the same number) per revolution. The ECM does not generate frequencies faster than this decision frequency (except for harmonics).

Figure 8:
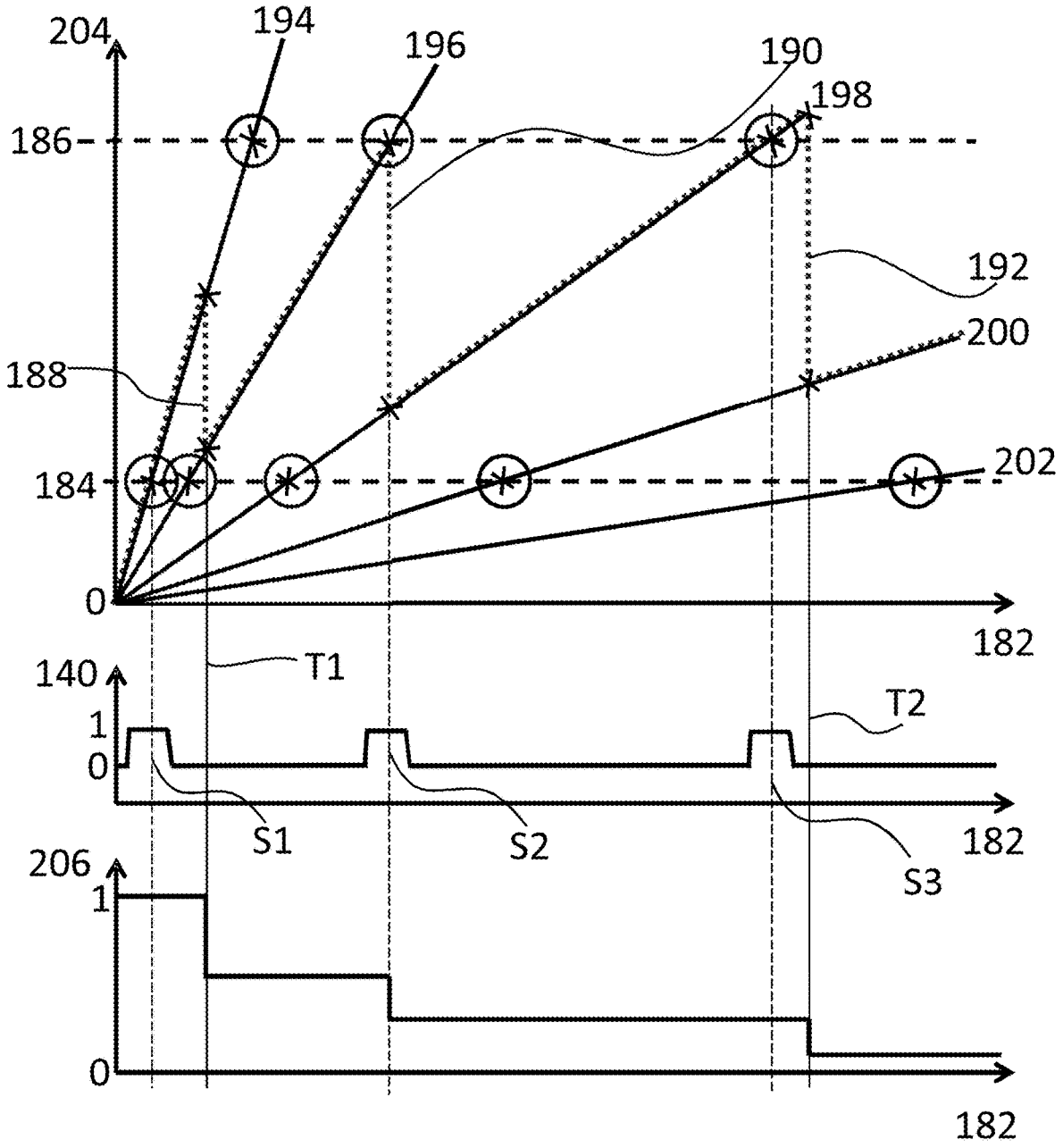
FIG. 8 is a series of plots of the relationships between RPM and predicted shaft dominant frequency, conservative mode activation (or deactivation) and displacement demand (Fd) during operation of an embodiment of the invention, wherein two modes are encountered.

FIG. 8 is a series of related plots of the relationships between shaft speed (w, for example expressed as RPM) and predicted dominant shaft frequency (204), activation (or de-activation) of conservative mode 140, and displacement demand (Fd) 206 during operation of an embodiment of the invention, wherein two vibration modes, a first mode 184 and a second mode 186 arise in response to working machine variables. These plots also indicate three transitions, a first transition (188) (where Fd has dropped from 1 to 0.5), a second transition 190 (where Fd has dropped from 0.5 to 0.3) and a third transition 192 (where Fd has dropped from 0.3 to 0.1). Variables include the fraction of maximum displacement, for example, where 12 cylinders are activated in one revolution of the rotatable shaft this represents maximum displacement (194), where 6 cylinders are activated in one revolution of the rotatable shaft, this represents 50% of maximum displacement (3 cylinders represents 25% (198), 2 cylinders 12.5% (200) and 1 cylinder 0.833% (202)).

In some embodiments the invention may be implemented in a system for which there is no available information about shaft frequency resonant modes of oscillation, or where the resonant modes change during operating of the machine. For example, the system may be a vehicle which has two or more speed ranges (e.g. a "high" speed range and a "low" speed range) wherein a first speed range has different shaft dynamics to a second speed range, but it may not be clear which speed range is selected at a given time. In such a case, the controller may also monitor the effectiveness of conservative mode, optionally by measuring how frequently the variable proportional conservative mode is acting. If conservative mode acts frequently (e.g. if it is active for more than 10% of the time) then it may be that conservative mode is presently insufficiently effective and may simply need to be tuned, for example by increasing the extent to which the valve timings are advanced (or retarded in the case of pumping). In addition, or alternately, conservative mode could generate an alert to an operator.

Where there is no available information about shaft frequency resonant modes of oscillation, it may be that the frequencies are constant, but simply unknown. In such a case, the activity of the feedback system may be used to populate a database (e.g. a table) of estimated shaft modes, calculated via a statistical analysis of the dominant shaft ripple frequency (including analysis of the enabling pattern of cylinder actuation and the RPM) and the actual activity of the feedback system. Accordingly, frequencies which cause excitation leading to conservative mode activation can be determined. This information can then be subsequently used to pro-actively enable conservative mode at the frequencies so determined.

Figure 9:
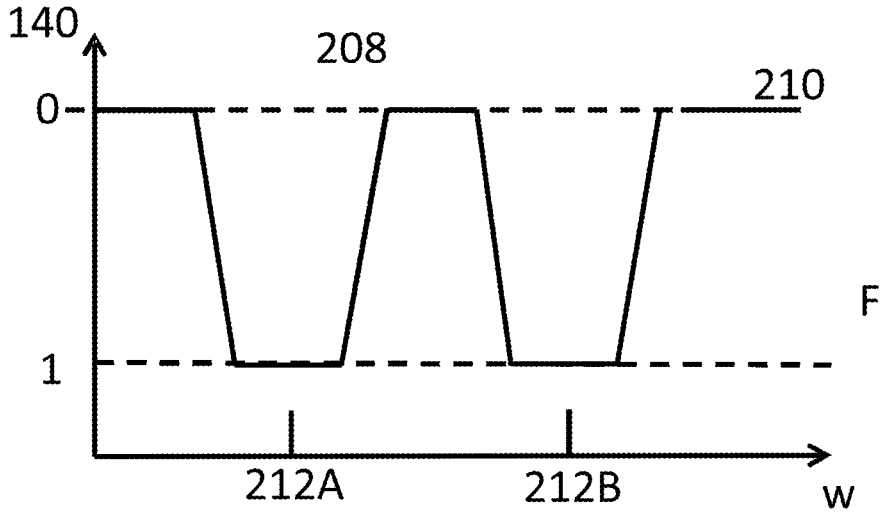
FIG. 9 is a plot of conservative mode as a function of shaft rotation speed (w)

In an example, a machine may require three cylinders to be actuated per revolution, leading to a dominant frequency of shaft ripple of 6 times per revolution. At 200 RPM, this would produce a torque ripple at 20 Hz, a frequency which could lead to damage to the machine. Accordingly, conservative mode may be activated at 200 RPM to pre-emptively avoid the resonance of the shaft at this frequency. FIG. 9 is a plot indicating an example of this where conservative mode 140 is either activated to some non-zero degree (1) or is not activated (0) in dependence on the RPM 182. In this example, both six cylinder activations per revolution (208) at 200 RPM (212A), and 3 cylinders per revolution (210) at 700 RPM (212B) cause shaft ripple at undesirable frequencies and, accordingly, conservative mode is activated to mitigate this.

Figure 10:
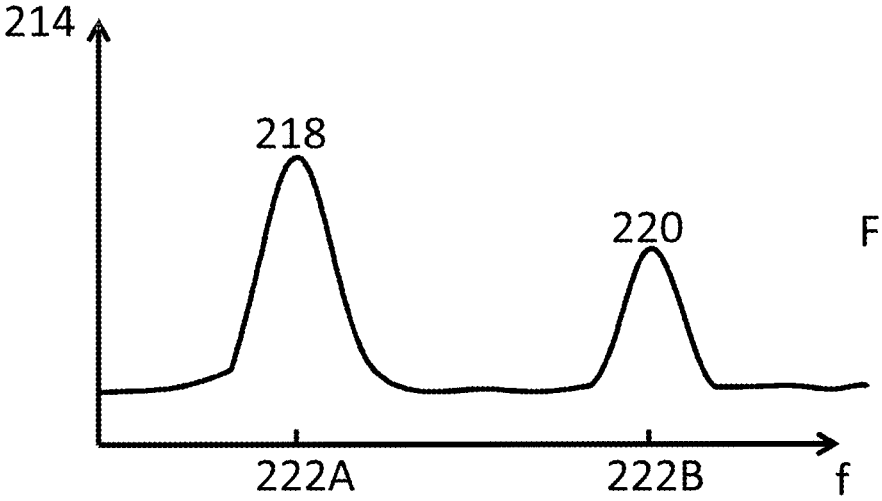
FIG. 10 is a plot of resonances as a function of shaft torque oscillation frequency (f)
Figure 11:
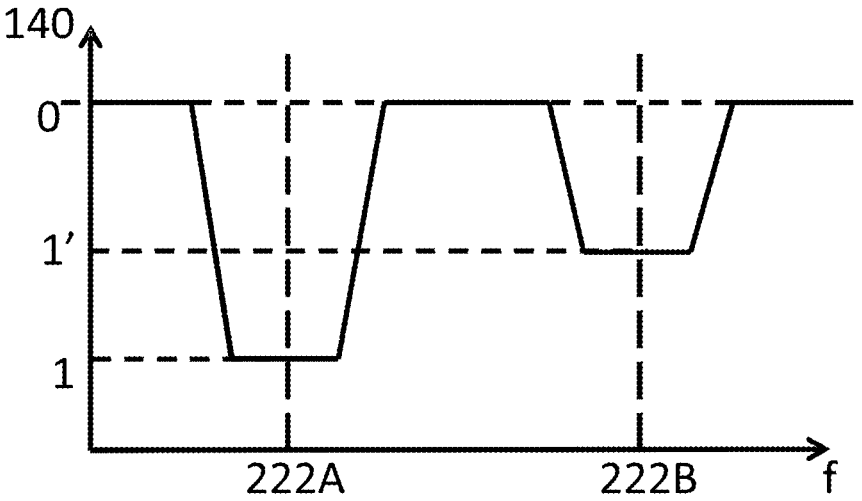
FIG. 11 is a plot of resonant mode response as a function of shaft torque oscillation frequency (f)

In an example where the natural resonant modes of vibration are known at the design stage, a database may be used to predetermine the activation of cylinders where shaft torque ripple is at, or close to, or otherwise likely to excite a resonant mode. FIG. 10 is an example of a plot of resonant mode response (214) as a function of shaft torque frequency (f), where data (which may be obtained either via simulation or measurement of an existing system) includes two resonant modes, a first resonant mode (218) at 20 Hz (222A) and a second resonant mode (220) at 70 Hz (222B) are excited to a greater or lesser degree. FIG. 11 is a plot indicating how conservative mode 140 might be activated in response to such measured or simulated data, such that conservative mode is selectively and proportionally activated at a predicted shaft torque frequency (224) of 20 Hz and at 70 Hz to prevent the resonant modes at these frequencies from being excited (1,1'). The ranges of rotation speeds (212A) and (212B) at which conservative mode is employed may be varied dynamically.

Figure 13:
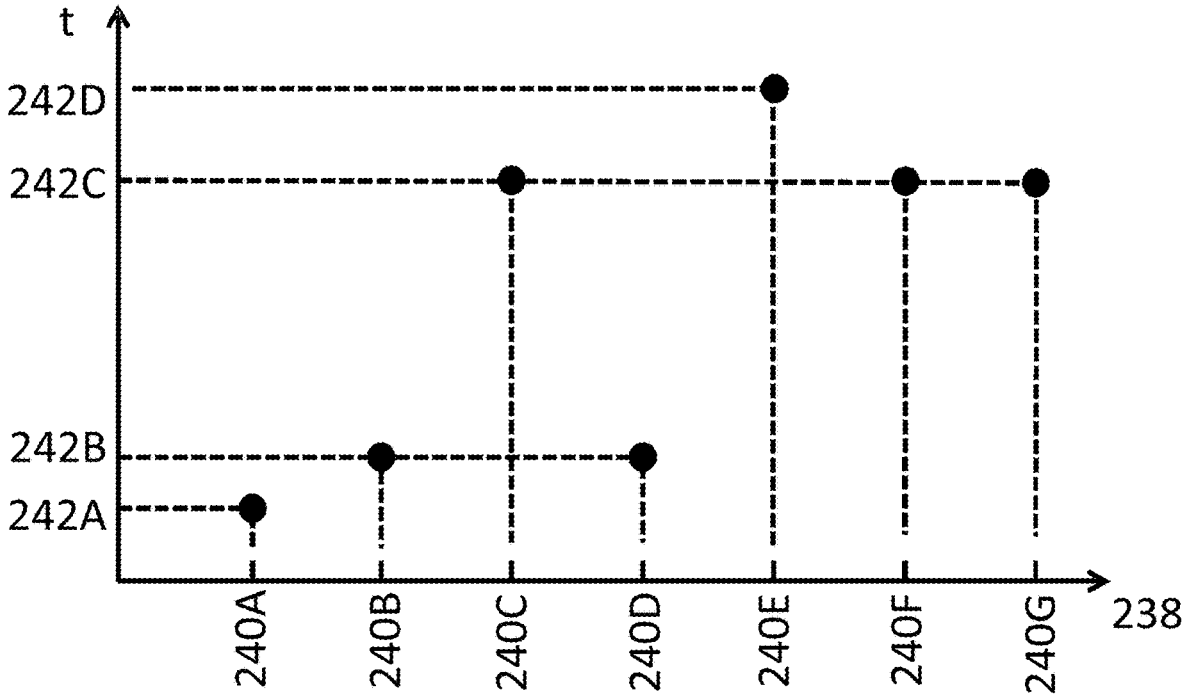
FIG. 13 is a plot of the dominant harmonic of shaft-period as a function of cylinders used per revolution.

FIG. 13 is a plot of the dominant harmonics of shaft periods (t) as dependent upon the number of cylinders used per revolution of the rotatable shaft 238. Where twelve cylinders are available, 1 (240A), 2 (240B), 3 (240C), 4 (240D), 6 (240E), 8 (240F) or all 12 (240G) cylinders might be used. This can occur in a quantised or wheel-motor mode, where fixed patterns of cylinders are used per revolution. In this case, the dominant frequencies present in the torque or flow, for a given shaft speed, are known. Thus, the transformation from a non-resonant state to a resonant state may be continuous (in the case of Fd operation) or it may be discrete, for example, where finite length fixed patterns of cylinder actuation of predetermined length are used (e.g. . . . 1010101010 . . . or . . . 001001001001001 . . . ). In the case of finite length fixed patterns of cylinder actuation, the known dominant frequency of torque ripple may be combined with the speed of rotation of the rotatable shaft to find a resonance, and the found resonance can be used to populate a database (for example, a table).

Figure 15:
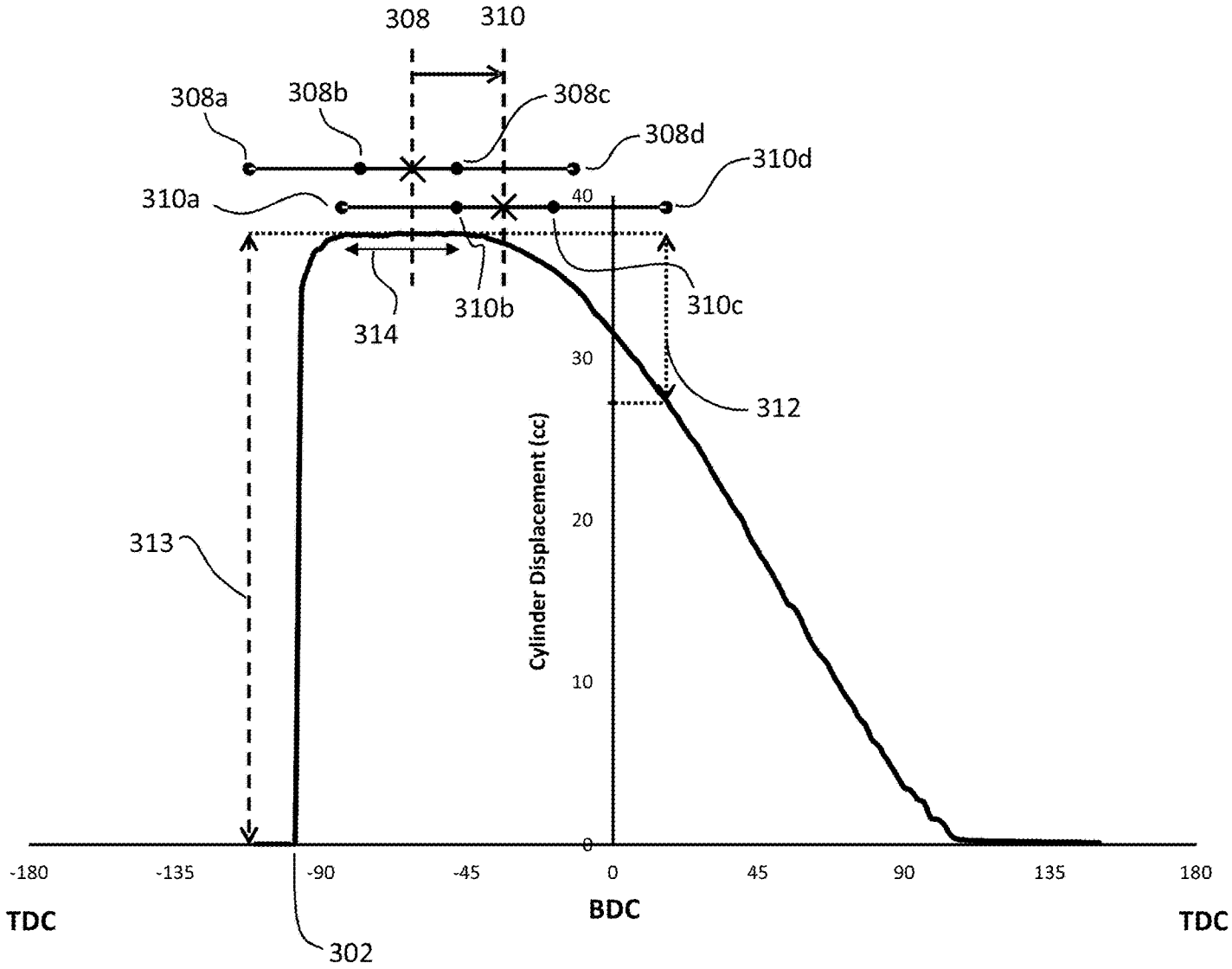
FIG. 15 is a graph of net displacement volume with LPV closing phase angle during pumping and the effect of conservative mode on that volume.

Effects of Conservative Mode Valve Timing on Absolute Displacement Fraction (ADF) and Displacement Output Error FIG. 15 illustrates cylinder displacement volume 300 (the y axis is cubic centimetres) as a function of the phase angle of closure of the LPV during a pumping cycle.

In respect of FIG. 15, the graph is not a cumulative cylinder displacement trace. Instead the curve represents the cylinder volume of working fluid (HP fluid which passes from the working chamber via the HPV to the HP manifold) which is displaced for the range of phases that the LPV may be chosen to be actuated to close. When it is engaged during pumping, valve timing in conservative mode takes into account the characteristic shape of the cylinder displacement curve, seeking to reduce or prohibit operation at or near the left end of the plateau 314, where the left end of the plateau is marked by the cut-off phase 302. If the LPV is closed before the cut-off phase 302 the respective displacement is zero. The characteristic shape arises from the nature of ECM HP and LP valve operation. Conservative mode aims to avoid closure of the LPV in advance of the cut-off phase 302 by retarding the target phase of the LPV closure. By sufficiently retarding the LPV closure, bearing in mind that there will be some error in the precise phase of closure, it is more likely (relatively certain) that LPV closure will occur on the plateau or at worst at slightly later phases where the gradient of the cylinder displacement volume is gentle and so the impact of conservative mode on net displacement is relatively limited. 308 is the target phase of LPV closure in default mode and 310 is the target phase of LPV closure in conservative mode. In the present example, conservative mode introduces a minimal reduction of total net displacement, ignoring the effects of variations in the precise phase due to shaft accelerations. With a small variation in the precise phase, or a larger variation (for example due to a substantial transient shaft acceleration), the impact on the cylinder displacement is still within an acceptable range. In more depth, in the example shown, the actual phase in default mode will in practice vary between 308*a* and 308*d* if there are relatively large errors in shaft speed, and between 308*b* and 308*c* for small errors. Similarly, in the present example the target phase of LPV closure in conservative mode in practice could vary between 310*a* and 310*d* for a relatively large error in LPV phase. For such an error range, at its most extreme, there is a corresponding cylinder displacement error (312) of around 10cc as shown in FIG. 15. At the other end (310*a*) of the relatively large error phase range, the corresponding displacement error is either zero or not substantial. The retarded target phase 310 of conservative mode has minimal effect on expected displacement, but the radical advantage is that even if there is a large error (shown as the range extending between 310*a* and 310*d*) in the executed phase, the resulting reduction of displacement is either zero or not substantial. In this example, the reduction of displacement in default mode, resulting from a large phase time delay 308*d* is approximately 4cc, versus 10cc reduction in displacement in conservative mode with large phase time delay 310*d*. Thus conservative mode, over default mode, results in a greater reduction in displacement for a similar large phase error. However this is outweighed by a primary benefit of conservative mode, evident considering that without conservative mode, if target phase 308 was retained, there would be a risk of zero displacement, leading to displacement error 313, if the LPV closed particularly early at a large phase time advance 308*a*. Such total cycle failure can be a significant issue in ECM operation.

Figure 16:
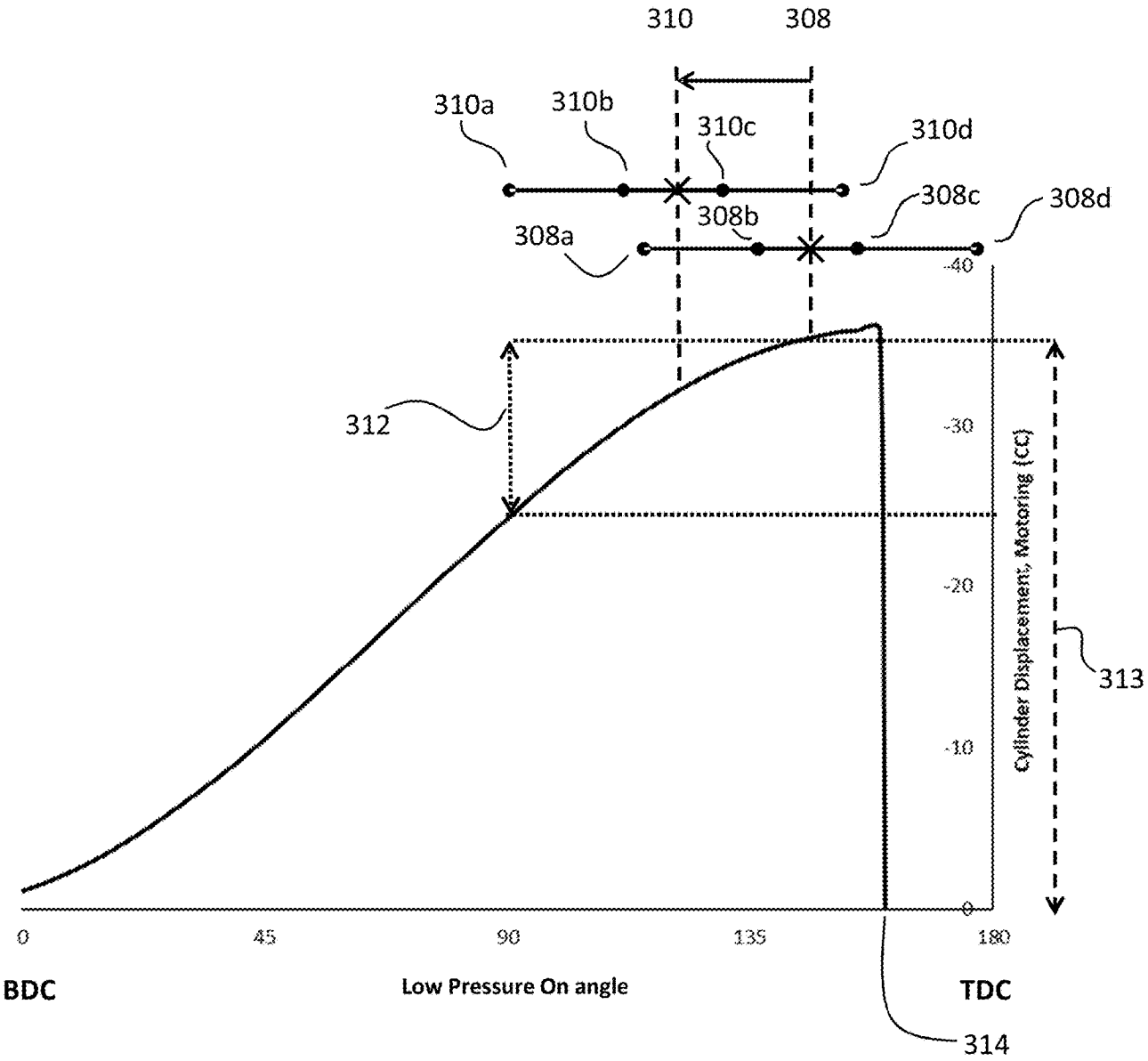
FIG. 16 is a graph of net displacement volume with LPV closing phase during motoring and the effect of conservative mode on that volume.

Similar effects can be seen with motoring, as shown in FIG. 16 where the effect of LPV close angle on displacement during motoring can be seen. If LPV close angle is delayed too far then this will lead to a sudden collapse in displacement after a cut-off phase 314, as approaching TDC late LPV closure means insufficient working fluid is trapped in the working chamber to raise the pressure sufficiently during further contraction to enable the pressure to sufficiently balance across the HPV to allow it to open. Again there is a change of target phase from phase 308 in default mode to 310 in conservative mode, although in this case the phase is advanced rather than retarded. There is a sort of plateau, this time without the flat top, but the effect of conservative mode is the same. Operation in conservative mode reduces or even eliminates the risk of the LPV closure phase being after cut-off phase 314 for even a large error in LPV closure phase (308*d*).

In respect of FIGS. 15 and 16, timing is interchangeable with phase, as a reference to a particular position (angle) of a piston within a cycle. Each graph relates the phase of this closure of the LPV, to the displacement of fluid from a single piston stroke. Each graph illustrates the margin of phase (timing) of firing, at a particular speed, required to produce a desired displacement. For a given phase of the control signal for the LPV, we can 'read off' from the line the displacement which will result in the event that there is no error in LPV close time.

A smaller displacement error is preferable in simple terms of meeting the displacement demand and minimising peak to peak ripple. Therefore, if high shaft acceleration is expected or detected, the LPV ON angle could be retarded (i.e. the conservative mode used) in order that a successful pumping stroke occurs albeit at reduced flow, rather than a complete failure to pump.

Although in the above example, the controller 50 controls the apparatus (vehicle) as a whole, as well as controlling valve opening and closure, and determining whether to apply default or conservative mode, these functions and others of the controller can be distributed between two or more components, for example a machine controller which controls the apparatus as a whole, and an ECM controller which controls the valve opening and closure in response to signals received from the machine controller.

The invention claimed is:

1. Apparatus comprising a fluid working machine, the fluid working machine comprising a rotatable shaft, at least one working chamber having a volume which varies cyclically with rotation of the rotatable shaft, a low pressure manifold and a high pressure manifold, a low pressure valve for regulating communication between the low pressure manifold and the working chamber, a high pressure valve for regulating communication between the high pressure manifold and the working chamber, a controller configured to actively control one or more said valves in phased relationships with cycles of working chamber volume, to determine the net displacement of fluid by the working chamber on a cycle by cycle basis, wherein for a given cycle type, the controller is configured to by default transmit control signals to the low or high pressure valves at a default phase angle of a cycle of working chamber volume, the control signals causing the opening or closing of the low or high pressure valves and, responsive to an event associated with a temporary change in the pressure in the high pressure manifold, to transmit the control signals at an alternative phase angle of cycles of working chamber volume, which alternative phase angle is advanced or retarded relative to the default phase angle.

2. A method of operating apparatus according to claim 1, comprising monitoring the speed of rotation of the rotatable shaft, detecting instances of temporary accelerations of the rotatable shaft, analysing operating parameters when the detected instances occur, determining parameters of a prediction algorithm responsive thereto and subsequently predicting events associated with a temporary acceleration of the rotatable shaft using the prediction algorithm and the determined parameters, and responsive thereto actively controlling the said opening or closing of the low or high pressure valve to temporarily occur at the alternative phase angle.

3. An apparatus according to claim 1, wherein when the phase of transmission of the control signal changes from the default phase angle to the alternative phase angle, or vice versa, the phase of transmission of the control signal changes progressively over a plurality of cycles of working chamber volume.

4. Apparatus comprising a fluid working machine, the fluid working machine comprising a rotatable shaft, at least one working chamber having a volume which varies cyclically with rotation of the rotatable shaft, a low pressure manifold and a high pressure manifold, a low pressure valve for regulating communication between the low pressure manifold and the working chamber, a high pressure valve for regulating communication between the high pressure manifold and the working chamber, a controller configured to actively control one or more said valves in phased relationships with cycles of working chamber volume, to determine the net displacement of fluid by the working chamber on a cycle by cycle basis, wherein for a given cycle type, the controller is configured to by default transmit control signals to the low or high pressure valves at a default phase angle of a cycle of working chamber volume, the control signals causing the opening or closing of the low or high pressure valves and, responsive to a measurement of an event associated with a temporary acceleration of the rotatable shaft, to transmit the control signals at an alternative phase angle of cycles of working chamber volume, which alternative phase angle is advanced or retarded relative to the default phase angle.

5. Apparatus according to claim 4, wherein the rotatable shaft is coupled to a drive train and wherein the measurement of an event associated with a temporary acceleration of the rotatable shaft is a measurement of an event associated with a discontinuity in the torque exerted on the rotatable shaft by the drive train.

6. An apparatus according to claim 4, wherein the event which is measured is a vibration arising from a pattern of a selection of working chambers to carry out active cycles in which a working chamber makes a net displacement of working fluid, and inactive cycles, in which a working chamber makes substantially no net displacement of working fluid.

7. Apparatus comprising a fluid working machine, the fluid working machine comprising a rotatable shaft, at least one working chamber having a volume which varies cyclically with rotation of the rotatable shaft, a low pressure manifold and a high pressure manifold, a low pressure valve for regulating communication between the low pressure manifold and the working chamber, a high pressure valve for regulating communication between the high pressure manifold and the working chamber, a controller configured to actively control one or more said valves in phased relationships with cycles of working chamber volume, to determine the net displacement of fluid by the working chamber on a cycle by cycle basis, wherein for a given cycle type, the controller is configured to by default transmit control signals to the low or high pressure valves at a default phase angle of a cycle of working chamber volume, the control signals causing the opening or closing of the low or high pressure valves and, responsive to an algorithmic prediction of an event associated with a temporary acceleration of the rotatable shaft, to transmit the control signals at an alternative phase angle of cycles of working chamber volume, which alternative phase angle is advanced or retarded relative to the default phase angle.

8. Apparatus according to claim 7, wherein the rotatable shaft is coupled to a drive train and wherein the algorithmic prediction of an event associated with a temporary acceleration of the rotatable shaft is an algorithmic prediction of an event associated with a discontinuity in the torque exerted on the rotatable shaft by the drive train.

9. A method of controlling an apparatus according to claim 1 or claim 4, the method comprising actively controlling one or more said valves in phased relationships with cycles of working chamber volume, to determine the net displacement of fluid by the working chamber on a cycle by cycle basis, wherein for a given cycle type, a control signal to cause the opening or closing of the low or high pressure valve is transmitted to the valve at a default phase angle of a cycle of working chamber volume and, responsive to a measurement or an algorithmic prediction of an event associated with a temporary acceleration of the rotatable shaft or an event associated with a temporary change in the pressure in the high pressure manifold, the corresponding control signal to cause the opening or closing of the low or high pressure valve is transmitted at an alternative phase angle of a cycle of working chamber volume, which alternative phase angle is advanced or retarded relative to the default phase angle.

10. A method according to claim 9 wherein, in the case that the cycle type is a motoring cycle in which there is a net displacement of working fluid from the high pressure manifold to the low pressure manifold, the method comprises either or both of (i) advancing the phase of the transmission of a control signal which causes the closing of the low pressure valve during the contraction stroke of a cycle of working chamber volume and (ii) advancing the phase of the transmission of a control signal which causes the opening of the high pressure valve during the expansion stroke of a cycle of working chamber volume.

11. A method according to claim 9 wherein, in the case that the cycle type is a pumping cycle in which there is a net displacement of working fluid from the low pressure manifold to the high pressure manifold, the method comprises retarding the phase of the transmission of a control signal which causes the closing of the low pressure valve during the contraction stroke of a cycle of working chamber volume.

12. A method according to claim 9, wherein the rotatable shaft is coupled to a drive train and wherein the event which is measured or algorithmically predicted is a discontinuity in the torque exerted on the rotatable shaft by the drive train.

13. A method according to claim 12, wherein a phase difference between the alternative phase angle and the default phase angle is varied such as to damp oscillations of the rotatable shaft or of the pressure in the high pressure manifold.

14. A method according to claim 12, wherein the discontinuity in the torque exerted on the rotatable shaft is predicted from the pattern of decisions as to the cycle type of successive cycles of working chamber volume.

15. A method according to claim 9, wherein the event which is measured or algorithmically predicted is an oscillation in the speed of rotation of the rotatable shaft.

16. A method according to claim 9, wherein the event which is measured or algorithmically predicted is a vibration arising from a pattern of a selection of working chambers to carry out active cycles in which a working chamber makes a net displacement of working fluid, and inactive cycles, in which a working chamber makes substantially no net displacement of working fluid.

17. A method according to claim 9, wherein events leading to an acceleration of the rotatable shaft are monitored and used to predict future events leading to an acceleration of the rotatable shaft.

18. A method according to claim 9, wherein the event which is predicted or algorithmically measured is algorithmically predicted responsive to a received actuation signal.

19. A method according to claim 9, wherein the fluid working machine is operated in a first (default) mode, with the control signals transmitted at the default phase angle, by default and is operated in a second (conservative) mode, with the control signals transmitted at the alternative phase angle, responsive to the measurement or algorithmic prediction of an event.

20. A method according to claim 9, wherein when the phase of transmission of the control signal changes from the default phase angle to the alternative phase angle, or vice versa, the phase of transmission of the control signal changes progressively over a plurality of cycles of working chamber volume.

21. A method according to claim 20, wherein the default phase angle is variable over time.

22. A method according to claim 9, wherein the difference between the default phase angle and the alternative phase angle is variable.

23. A method according to claim 9, wherein the default phase angle of transmission of the control signal varies with the measured speed of rotation of the rotatable shaft.

24. A method according to claim 9, wherein the difference between the alternative phase angle and the default phase angle is variable, in dependence on the expected magnitude of a temporary acceleration or in response to a measured variable, or in response to an AC component of speed of rotation of the rotatable shaft or high pressure manifold pressure.

25. A method according to claim 9, wherein the event is an event associated with a transient change in the pressure in the high pressure manifold.

26. An apparatus according to claim 7, wherein the event which is algorithmically predicted is a vibration arising from a pattern of a selection of working chambers to carry out active cycles in which a working chamber makes a net displacement of working fluid, and inactive cycles, in which a working chamber makes substantially no net displacement of working fluid.

* * * * *